US012017284B2

(12) United States Patent
Evans et al.

(10) Patent No.: US 12,017,284 B2
(45) Date of Patent: Jun. 25, 2024

(54) NANOMATERIALS

(71) Applicant: UNIVERSITY OF LEEDS, Leeds (GB)

(72) Inventors: Stephen Derek Evans, Leeds (GB); Sunjie Ye, Leeds (GB); Alexander Fred Markham, Leeds (GB); Patricia Louise Coletta, Leeds (GB)

(73) Assignee: University of Leeds, Leeds (GB)

( * ) Notice: Subject to any disclaimer, the term of this patent is extended or adjusted under 35 U.S.C. 154(b) by 299 days.

(21) Appl. No.: 17/295,700

(22) PCT Filed: Nov. 19, 2019

(86) PCT No.: PCT/GB2019/053274
§ 371 (c)(1),
(2) Date: May 20, 2021

(87) PCT Pub. No.: WO2020/104789
PCT Pub. Date: May 28, 2020

(65) Prior Publication Data

US 2021/0402472 A1 Dec. 30, 2021

(30) Foreign Application Priority Data

Nov. 21, 2018 (GB) ..... 1818923

(51) Int. Cl.
*B22F 9/24* (2006.01)
*B22F 1/054* (2022.01)
(Continued)

(52) U.S. Cl.
CPC ..... *B22F 9/24* (2013.01); *B22F 1/054* (2022.01); *B22F 1/0545* (2022.01);
(Continued)

(58) Field of Classification Search
None
See application file for complete search history.

(56) References Cited

U.S. PATENT DOCUMENTS 6,232,264 B1 * 5/2001 Lukehart ..... C07F 15/0046 502/339
6,660,058 B1 * 12/2003 Oh ..... C22B 34/1268 75/371

(Continued)

FOREIGN PATENT DOCUMENTS

CN 1482622 A * 3/2004
CN 110118769 A * 8/2019

OTHER PUBLICATIONS

Jiao, T. et al., "Synthesis and photocatalytic property of gold nanoparticles by using a series of bolaform Schiff base amphiphiles", Materials Research Bulletin, vol. 47, pp. 4203-4209, Available online Sep. 7, 2012.*

(Continued)

*Primary Examiner* — George Wyszomierski
(74) *Attorney, Agent, or Firm* — Harness, Dickey & Pierce, PLC

(57) ABSTRACT

The present application relates to a method for the production of a noble metal nanomaterial comprising: (A) adding an aqueous solution of a source of noble metal ions and a reducing agent to an aqueous solution of an organic compound to form a reaction mixture, wherein the organic compound is capable of undergoing 2D planar stacking in aqueous solution; and (B) separating the noble metal nanomaterial from the reaction mixture. The present application also relates to a noble metal nanomaterial manufactured according to said method.

Figure 1:
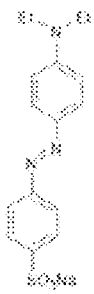
Figure 1:
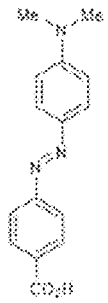
Figure 1:
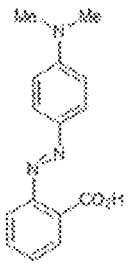
Figure 1:
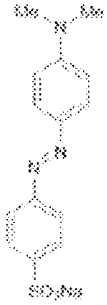

10 Claims, 26 Drawing Sheets a. Fenaminosulf b. 4-(Dimethylamino) benzoic acid c. 4-methylamino benzoic acid d. 2,2''-Bipyridyl

(51) Int. Cl.
*B22F 1/0545* (2022.01)
*B22F 1/07* (2022.01)
*C22C 1/04* (2023.01)

(52) U.S. Cl.
CPC ..... *B22F 1/0551* (2022.01); *B22F 1/07* (2022.01); *C22C 1/0466* (2013.01); *B22F 2301/255* (2013.01); *B22F 2304/05* (2013.01)

(56) References Cited

U.S. PATENT DOCUMENTS

| | | | | |
|---|---|---|---|---|
| 8,395,003 | B2 | 3/2013 | Leger et al. | |
| 2008/0166259 | A1* | 7/2008 | Kijima | C25B 11/081 420/466 |
| 2010/0228064 | A1 | 9/2010 | Leger et al. | |
| 2012/0046482 | A1* | 2/2012 | Guo | B22F 1/0551 977/762 |
| 2012/0148443 | A1 | 6/2012 | Whitcomb | |
| 2013/0075665 | A1* | 3/2013 | Park | B82Y 40/00 977/773 |
| 2018/0008967 | A1 | 1/2018 | Yu et al. | |

OTHER PUBLICATIONS

Tripathy, T. et al., "Green synthesis of Ag—Au bimetallic nanocomposites using a biodegradable synthetic graft copolymer: hydroxyethyl starch-g-poly (acrylamide-co-acrylic acid) and evaluation of their catalytic activities", European Polymer Journal, vol. 87, pp. 113-123, Available online Dec. 21, 2016.*

Murugan, E. et al., "Amphiphilic Dendrimer Stabilized Ag, Pd and Pt Homogeneous Nanoparticle Catalysts and Their Catalysis for the Reduction of Methyl Orange", International Conferance on Nanoscience, Engineering and Technology (ICONSET) 2011, pp. 35-39.*

Dong, H. et al., "The influence of amine structures on the stability and catalytic activity of gold nanoparticles stabilized by amine-modified hyperbranched polymers", Nanotechnology, vol. 29, Published Jan. 5, 2018.*

English translation of CN 1482622 (originally published Mar. 17, 2004), obtained from PE2E search.*

S Yang et al, Mater. Chem. Front, 2 (2018) pp. 456-467.

Y. Li et al, Nat. Commun., 5 (2014) p. 3093.

J. Jin et al, J.Am. Chem. Soc, 135 (2013) pp. 12544-12547.

Tripathy Tridib et al: "Green synthesis of Ag—Au bimetallic nanocomposites using a biodegradable synthetic graft copolymer; hydroxyethyl startch-g-poly (acrylamide-co-acrylic acid) and evaluation of their catalytic activities", European Polymer Journal, Pergamon Pres Ltd. vol. 87, (Dec. 21, 2016).

Zhang et al "Self-assembly of porphyrin-based supramolecules and their characteristics on gold nanoparticles", Colloids and Surfaces A: Physiochemical and Engineering Aspects, Elsevier, Amsterdam, NL vol. 302, No. 1-3 (May 11, 2007), pp. 219-224.

Haohong Duan et al "Ultrathin rhodium nanosheets", Nature Communications, vol. 5, No. 1 (Jan. 17, 2014).

International Search Report and Written Opinion of the International Searching Authority, issued in PCT/GB2019/053274, dated Jan. 31, 2020; ISA/EP.

GB Search Report dated Mar. 15, 2019 for GB 1818923.3.

* cited by examiner a. Ethyl orange b. Para methyl red c. Methyl red d. Methyl orange a. Fenaminosulf b. 4-(Dimethylamino) benzoic acid c. 4-methylamino benzoic acid d. 2,2``-Bipyridyl

NANOMATERIALS

CROSS-REFERENCE TO RELATED APPLICATIONS

This application is a 371 U.S. National Stage of International Application No. PCT/GB2019/053274, filed on Nov. 19, 2019, which claims priority to British Application No 1818923.3, filed on Nov. 21, 2018. The entire disclosures of the above applications are incorporated herein by reference.

The present invention relates to a method for the production of a noble metal nanomaterial and to the noble metal nanomaterial per se.

Two-dimensional (2D) nanomaterials which are up to several atomic layers thick but with a much greater lateral area have stimulated enormous research interest. As exemplified by graphene, 2D nanomaterials have unique electronic, mechanical and surface-related properties that arise from their reduced dimensionality compared to their bulk counterparts.

Free-standing ultra-thin 2D metal nanostructures have a wide range of potential applications. The increase in exposed active metallic sites compared to a 3-dimensional (3D) material leads to enhanced catalytic activity. Lower resistivity in 2D metal nanostructures has potential applications in batteries and electronic devices. 2D metal nanostructures can also exhibit surface plasmon resonance, a fundamental principle for many techniques including optical sensing, semiconductor optical absorption enhancement and other colour-based biosensor techniques. This has potential medical applications including photothermal therapy for cancer treatment.

Present production methods for 2D metal nanomaterials can be broadly characterised into physical and chemical. Physical methods include compression using high temperature and pressure conditions, as well as repeated size reduction whereby stacked metal sheets are repeatedly folded and compressed. Such methods can currently achieve metal nanomaterials with thicknesses as low as 0.9 nm (S Yang et al, *Mater. Chem. Front,* 2, 2018, 456-467).

Chemical techniques typically involve using soluble metal precursors. Nanomaterial growth is initiated through the use of a reducing agent to reduce the soluble metal eventually to neutral metal atoms. These atoms provide nucleation sites for the growth of the nanomaterial.

Many chemical techniques rely on the use of solid substrates such as mica, silica and graphite upon which the metal film is grown. US-A-2008/166259 describes the use of immobilised micelles on the surface of a solid substrate as a site for the reduction of noble metals including platinum and gold. This method leads to the formation of metal nanoparticles with a thickness of 2-5 nm. The thickness, shape and size of the nanoparticle is controllable by altering the surfactants.

The production of ultra-thin 2D metallic nanomaterials free of a solid substrate represents a significant challenge. This is due to the natural tendency of metal atoms to form a highly isotropic 3D close-packed crystal lattice. This natural tendency can be suppressed by the introduction of a confinement substance to induce anisotropic growth which is essential for the generation of 2D metal nanostructures. To date, a range of synthesis strategies have been utilised to prohibit the free growth of primary metal nuclei and promote 2D anisotropic growth using a variety of confinement substances. These confinement substances include surfactants (such as polymers and active gases that selectively bind onto low-index metal surfaces) and templates (such as lamellar hydrogels, graphene and graphene derivatives).

Ultra-thin Rh nanosheets with a reported thickness of 0.4 mu have been synthesised using a poly(vinylpyrrolidone) polymer support (Y. Li et al, *Nat. Commun.,* 5, 2014, 3093). However this process relies on a high reaction temperature.

Au nanosheets have been prepared by utilising the lamellar bilayer structure of dodecylglyceryl itaconate (DGI). The thickness of nanosheets is tuneable from several nanometres to tens of nanometres by altering the concentration of DGI to influence the spacing of bilayers in the lamellar structure. (J. Jin et al, *J. Am. Chem. Soc.,* 135, 2013, 12544-12547). However this process cannot produce atomically thin metal nanostructures.

The present invention seeks to improve the formation of noble metal nanomaterials by providing a wet-chemical synthesis of free-standing (ie substrate-free) metal nanostructures such as nanosheets which may be ultra-thin.

Viewed from a first aspect the present invention provides a method for the production of a noble metal nanomaterial comprising:

(A) adding an aqueous solution of a source of noble metal ions and a reducing agent to an aqueous solution of an organic compound to form a reaction mixture, wherein the organic compound is capable of undergoing 2D planar stacking in aqueous solution; and (B) separating the noble metal nanomaterial from the reaction mixture.

Typically the nanomaterial is characterised by the presence of (preferably the predominance of) nanostructures having one dimension (eg its thickness) which is ultra-thin. For example, there may be 50% or more of the nanostructures in the number size distribution having one dimension which is ultra-thin.

The nanomaterial may be characterised by the presence of (preferably the predominance of) nanostructures selected from the group consisting of nanoflakes, nanofilms, nanoplates, nanosheets (eg atomically thin nanosheets) and hierarchical superstructures thereof (eg superstructures of nanosheets such as quasi-spheres).

In a preferred embodiment, the nanomaterial is characterised by the presence of (preferably the predominance of) nanosheets.

The nanosheets may be atomically-thin.

The thickness of the nanosheets measured by atomic force microscopy (AFM) may be no more than 15 times the atomic radius of the noble metal (eg as measured empirically according to J. C. Slater, *J. Chem. Phys.,* 41, 1964, 3199-3205). Preferably the thickness of the nanosheets measured by atomic force microscopy (AFM) is no more than 10 times the atomic radius of the noble metal (eg as measured empirically according to J. C. Slater, *J. Chem. Phys.,* 41, 1964, 3199-3205). Particularly preferably the thickness of the nanosheets measured by atomic force microscopy (AFM) is no more than 6 times the atomic radius of the noble metal (eg as measured empirically according to J. C. Slater, *J. Chem. Phys.,* 41, 1964, 3199-3205).

The thickness of the nanosheets measured by atomic force microscopy (AFM) may be no more than 8 atomic layers. Preferably the thickness of the nanosheets measured by atomic force microscopy (AFM) is no more than 5 atomic layers. Particularly preferably the thickness of the nanosheets measured by atomic force microscopy (AFM) is no more than 3 atomic layers.

The average thickness of the nanosheets may be 0.50 nm or less (as measured by atomic force microscopy (AFM)). Preferably the average thickness of the nanosheets is in the range 0.40 to 0.50 nm.

The thickness distribution of nanosheets (as measured by atomic force microscopy (AFM)) may be in the range 0.26 to 0.54 nm.

In a preferred embodiment, the nanomaterial is characterised by the presence of (preferably the predominance of) nanoplates (eg single crystalline nanoplates).

The average thickness of the nanoplates may be 5 nm or more (as measured by atomic force microscopy (AFM)).

The average edge length of the nanoplates may be 100 nm or more (as measured by TEM).

The noble metal nanomaterial may be an element or an alloy.

The noble metal may be an element selected from the group consisting of gold (Au), silver (Ag), platinum (Pt), iridium (Ir), osmium (Os), ruthenium (Ru), palladium (Pd) and rhodium (Rh).

Preferably the noble metal is Au or Pt. Particularly preferably the noble metal is Au.

The source of noble metal ions may be a noble metal compound. The noble metal compound may be organometallic. The noble metal compound may be acidic. The noble metal compound may be a noble metal halide. Preferably the noble metal compound is a noble metal chloride (eg $HAuCl_4$).

The reducing agent may be a citrate (eg a salt or ester of citric acid). The reducing agent may be a Group I or Group II metal citrate salt.

Preferably the molar ratio of the reducing agent to the source of noble metal ions in the reaction mixture is less than 15. Particularly preferably, the molar ratio of the reducing agent to the source of noble metal ions in the reaction mixture is in the range 8 to 12.

Preferably the molecules of the organic compound self-associate or self-assemble in aqueous solution.

Preferably the organic compound is capable of forming plate-like stacks in aqueous solution.

Preferably the organic compound is capable of providing intermolecular interactions in two orthogonal directions (eg along the x and y axes). The intermolecular interactions may be a hydrophobic interaction in the x-y plane and a $\pi$-$\pi$ interaction in the z direction.

Preferably the organic compound has an affinity for noble metal ions. This affinity may be attributable to metal-$\pi$ interactions and/or chelation.

The organic compound may be capable of hydrogen bonding.

The molecules of the organic compound may comprise at least one heteroatom.

Preferably the organic compound is an organic amphiphile.

In a preferred embodiment, the molecules of the organic compound comprise a rigid aromatic moiety, a hydrophilic moiety and a hydrophobic moiety.

Preferably the organic compound is of molecular formula:

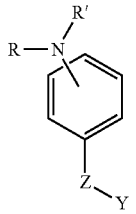

wherein:

R is hydrogen or a $C_nH_{2n+1}$ moiety, wherein $0<n\leq 6$;

R' is a $C_mH_{2m+1}$ moiety, wherein $0<m\leq 6$;

Z is a bond or a diazenyl or diazenylbenzene linking moiety; and

Y is a carboxyl-containing, carbonyl-containing, hydroxyl-containing, anhydride-containing, amino-containing, amido-containing, sulfhydryl-containing or sulphonyl-containing moiety.

Preferably Y is a carboxyl-containing moiety or sulphonyl-containing moiety. Particularly preferably Y is $SO_3Na$ or $CO_2H$.

Preferably Z is a diazenyl or diazenylbenzene moiety.

Preferably each of R and R' which may be the same or different is methyl or ethyl.

Preferably the organic compound is selected from the group consisting of methyl orange, ethyl orange, para methyl red, methyl red, fenaminosulf, 4-(dimethylamino) benzoic acid, 4-methylamino benzoic acid and 2,2'-bipyridine.

The organic compound may be an azo or non-azo compound.

The organic compound may be an azo compound (eg a dye) such as methyl orange, ethyl orange, para methyl red, methyl red or fenaminosulf.

The organic compound may be a non-azo compound such as 4-(dimethylamino) benzoic acid, 4-methylamino benzoic acid, 2,2'-bipyridine or a 2,2'-bipyridine derivative.

Preferably in step (A), the aqueous solution of a source of noble metal ions and the reducing agent are added sequentially to the aqueous solution of the organic compound.

The method may further comprise:

(A1) leaving the reaction mixture undisturbed for a period of time (eg about 12 hours).

Step (B) may be carried out by centrifugation. The product of step (B) may be a pellet. The product (eg pellet) may be washed one or more times with ultra-pure water until the supernatant is colourless.

Step (A) may be carried out at ambient temperature (eg at a temperature in the range 0° C. to 50° C.). Preferably step (A) is carried out at temperature in the range 10° C. to 30° C.

At ambient temperature, the time period for the reaction to reach completion is typically less than 24 hours (eg in the range 10 to 14 hours).

Step (A) may be carried out at ambient pressure.

By varying the molar ratio of the organic compound to the source of noble metal ions, it may be possible to control the formation of different types of metal nanomaterial. For example at low molar ratios, the nanomaterial may be characterised by the presence of (preferably the predominance of) ultra-thin metal nanoflakes and nanosheets. For example at high molar ratios, the nanomaterial may be characterised by the presence of (preferably the predominance of) higher order nano-architectures.

Preferably the molar ratio of the organic compound to the source of noble metal ions in the reaction mixture is 2 or less. Particularly preferably, the molar ratio of the organic compound to the source of noble metal ions in the reaction mixture is in the range 0.10 to 0.5.

In a preferred embodiment, the method further comprises:

(A') adding an aqueous solution of an inorganic salt to the reaction mixture.

This embodiment allows for the advantageous formation of single-crystal metal nanoplates, the thickness and edge lengths of which can be controlled by changing the molar ratio of the inorganic salt to the source of noble metal ions.

The inorganic salt may be a Group 1 metal salt or a transition metal salt. Preferably the inorganic salt is an iron or sodium salt.

The inorganic salt may be a halide. Preferably the inorganic salt is a bromide.

Preferably in step (A'), the molar ratio of the inorganic salt to the source of noble metal ions in the reaction mixture is less than 1. Particularly preferably, the molar ratio of the inorganic salt to the source of noble metal ions in the reaction mixture is in the range 0.1 to 0.8.

Viewed from a further aspect the present invention provides a noble metal nanomaterial as hereinbefore defined.

The noble metal nanomaterial is preferably obtainable by a method as hereinbefore defined.

The invention will now be described by reference to specific Examples and the following Figures. These Examples and Figures are not to be considered as limiting the scope of the present invention.

FIG. 1: Molecular structures of a selection of organic compounds suitable for use in the present invention.

Figure 2:
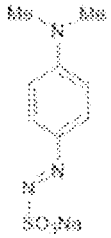
Figure 2:
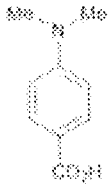
Figure 2:
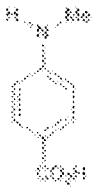
Figure 2:
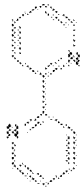

FIG. 2: Molecular structures of a further selection of organic compounds suitable for use in the present invention.

Figure 3:
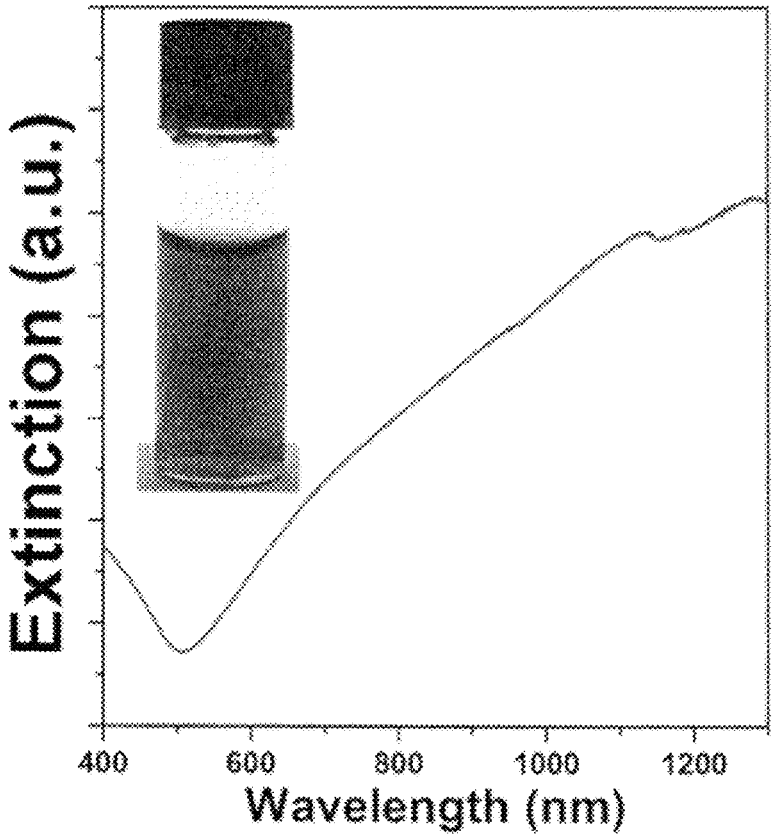

FIG. 3: Photograph and UV-vis spectrum of the reaction mixture after 12 hours according to Example 1.

Figure 4:
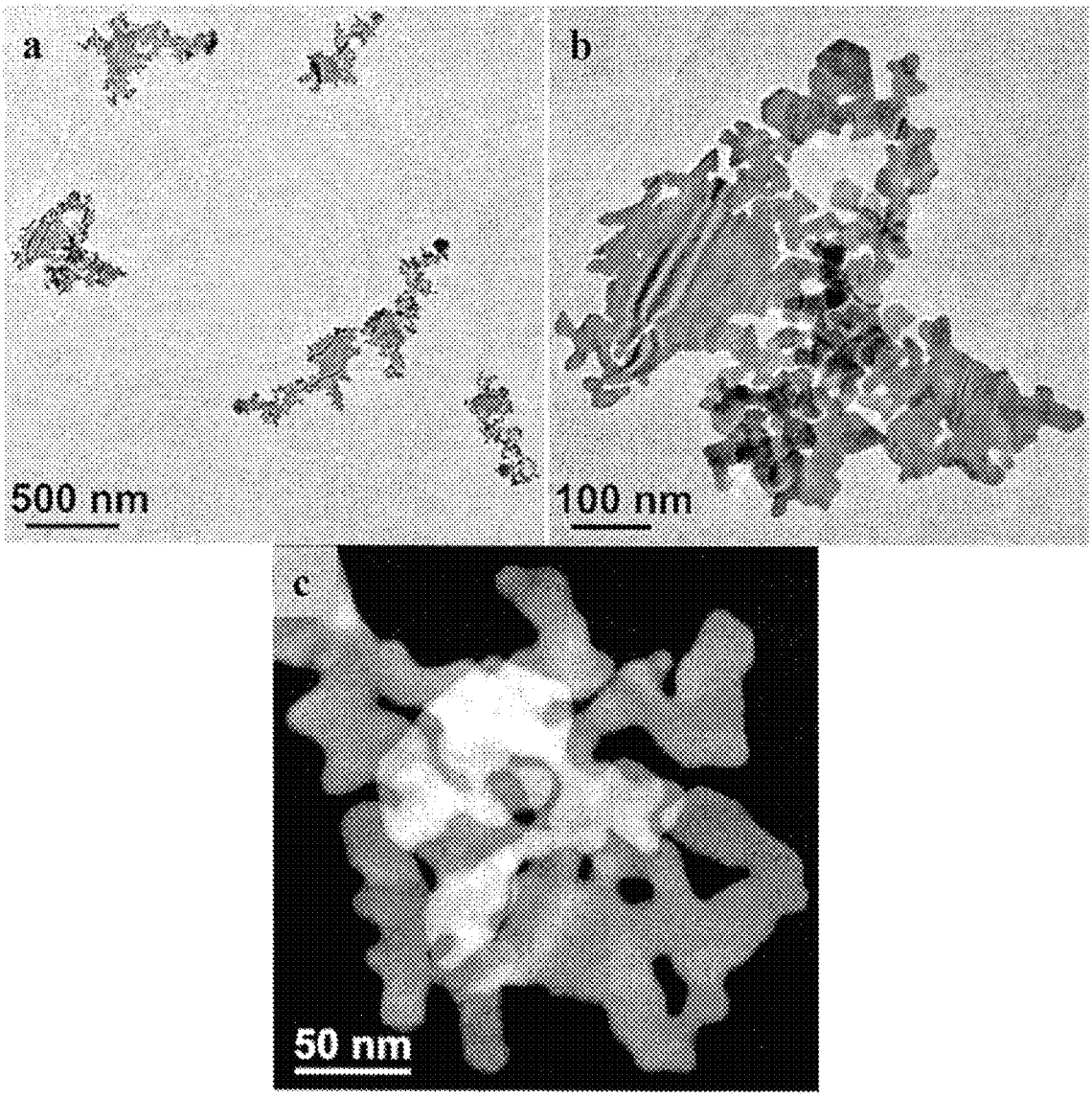

FIGS. 4*a* and 4*b*: Bright field TEM images of ultra-thin metal nanosheets according to Example 1.

FIG. 4*c*: Dark field STEM image of ultra-thin metal nanosheets according to Example 1.

Figure 5:
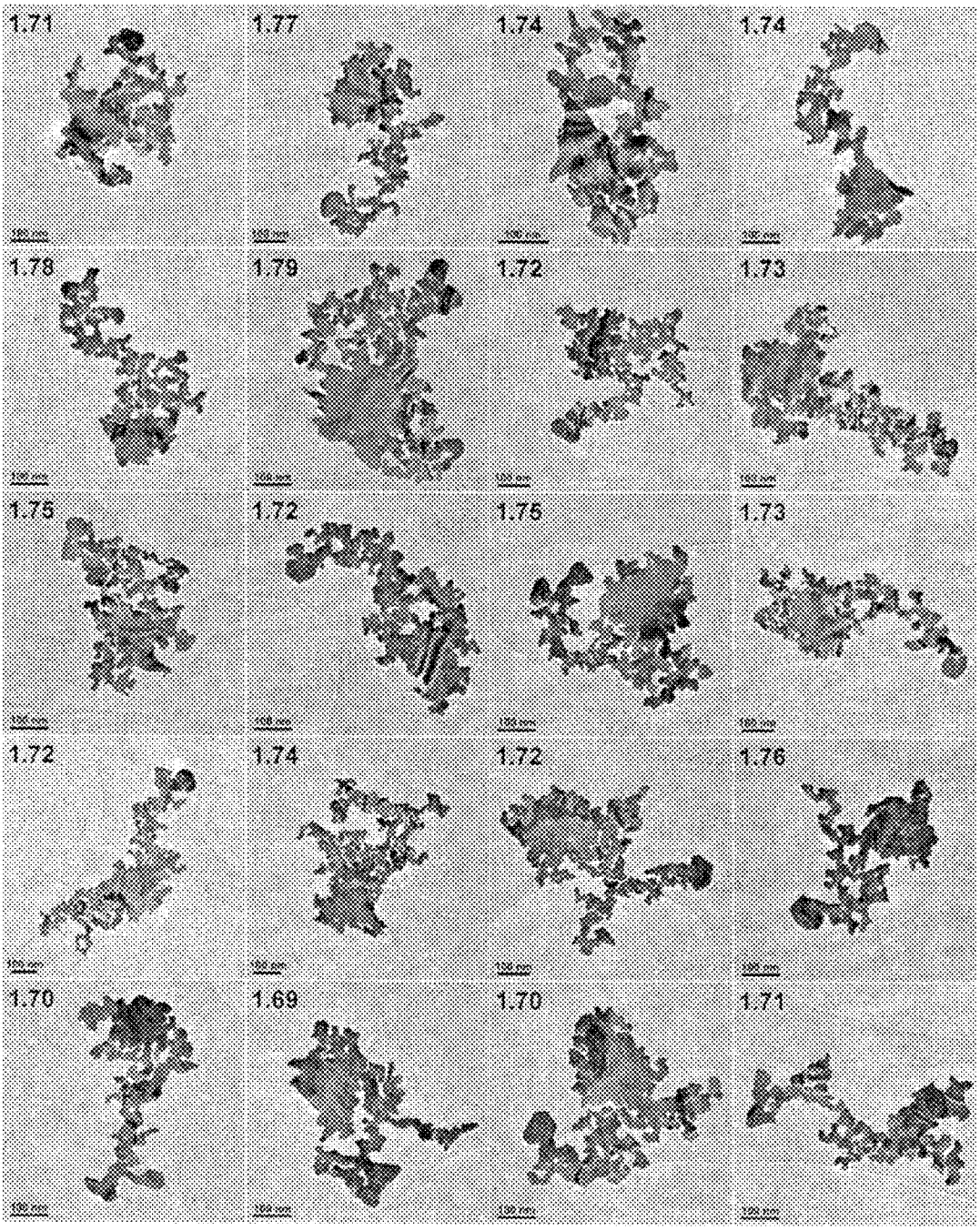

FIG. 5: TEM images of 20 different ultra-thin metal nanosheets with their calculated fractal dimensions according to Example 1.

Figure 6:
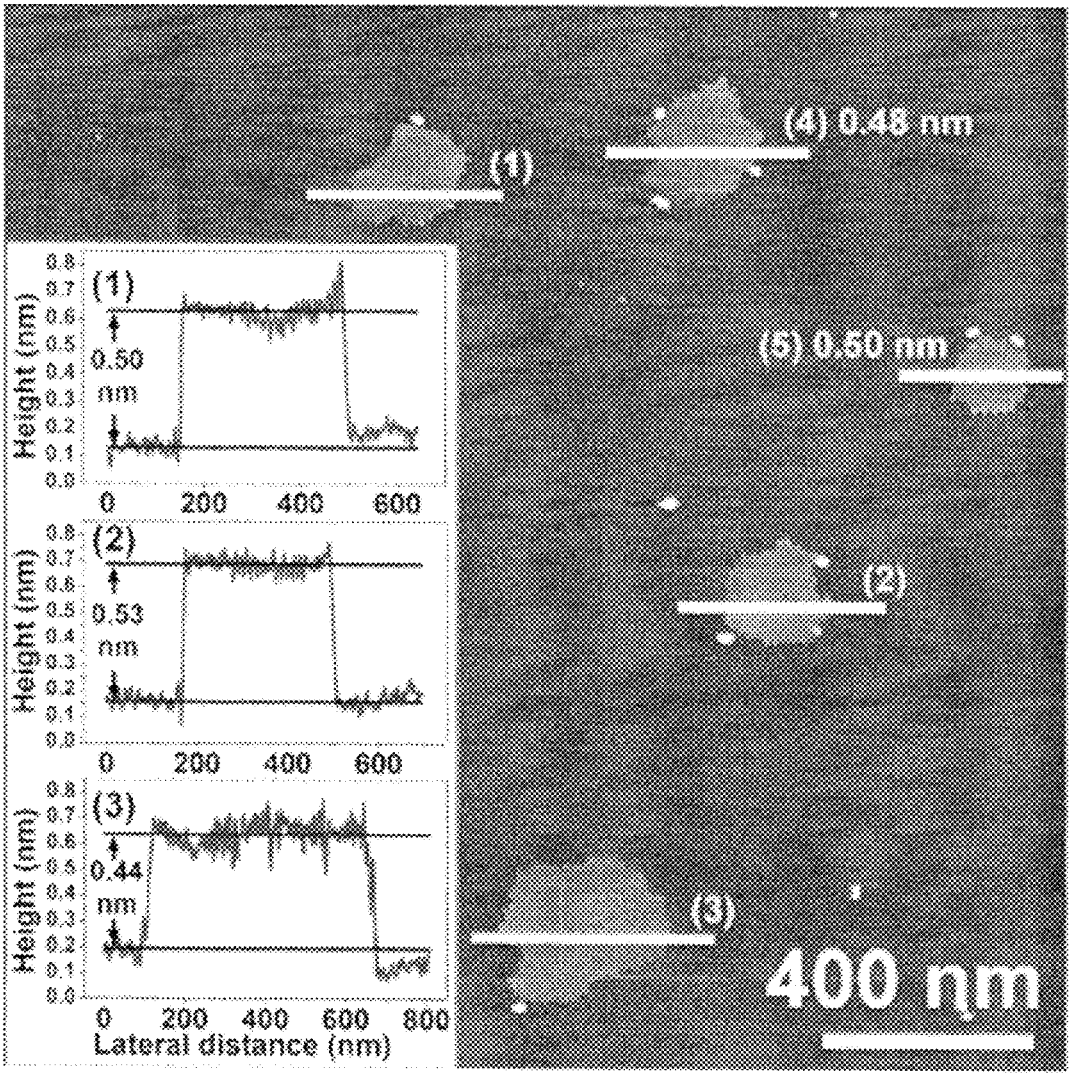

FIG. 6: AFM image of 5 ultra-thin metal nanosheets according to Example 1 with thickness profiles for 3 nanosheets along the marked white lines displayed as an inset.

Figure 7:
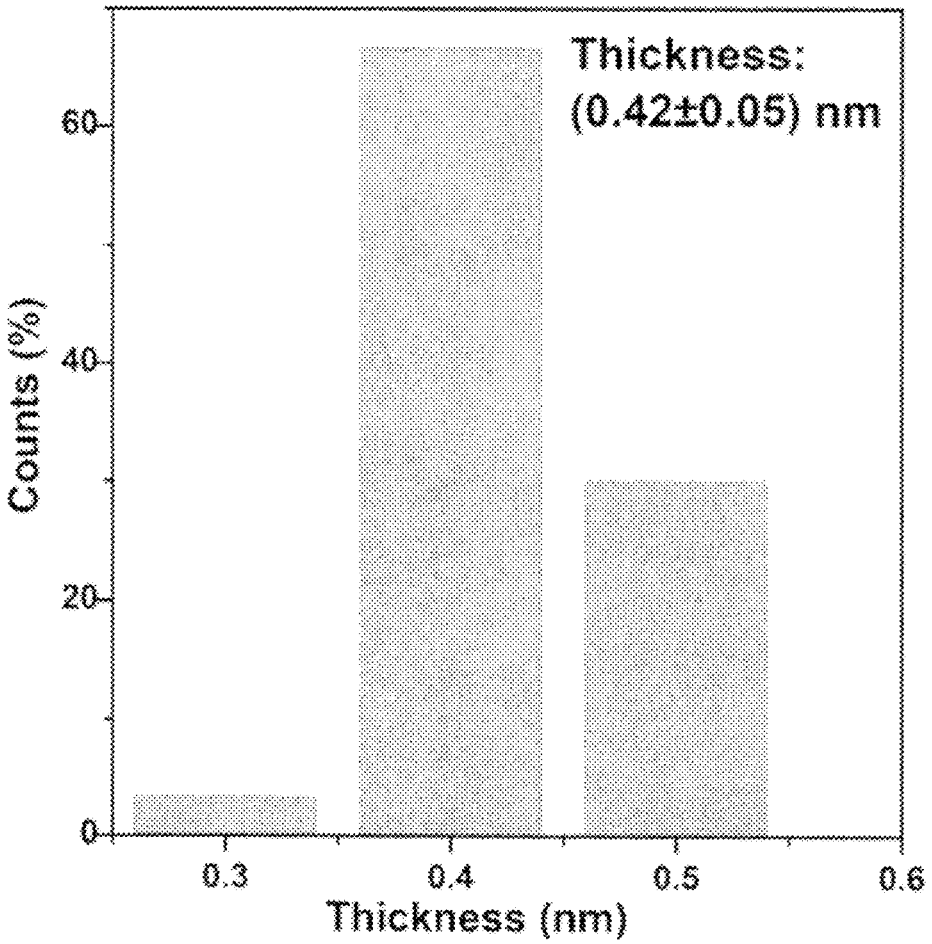

FIG. 7: Histogram of average thickness data obtained by AFM for 30 different ultra-thin metal nanosheets according to Example 1.

Figure 8:
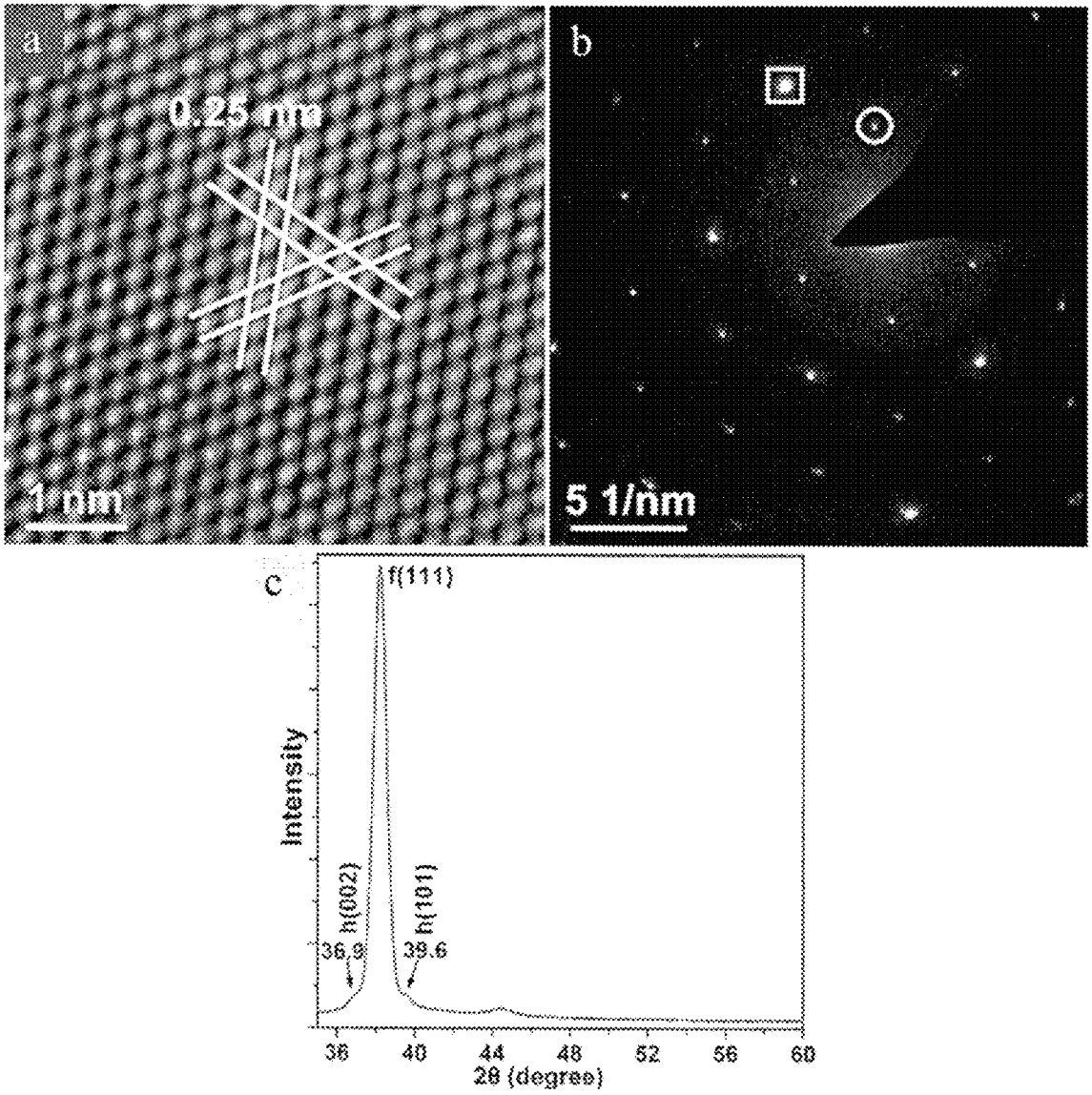

FIG. 8*a*: HRTEM image of an ultra-thin metal nanosheet according to Example 1.

FIG. 8*b*: SAED pattern in the <111> zone axis of ultra-thin metal nanosheets according to Example 1.

FIG. 8*c*: XRD pattern over a 2θ range from 30° to 60° of ultra-thin metal nanosheets according to Example 1.

Figure 9:
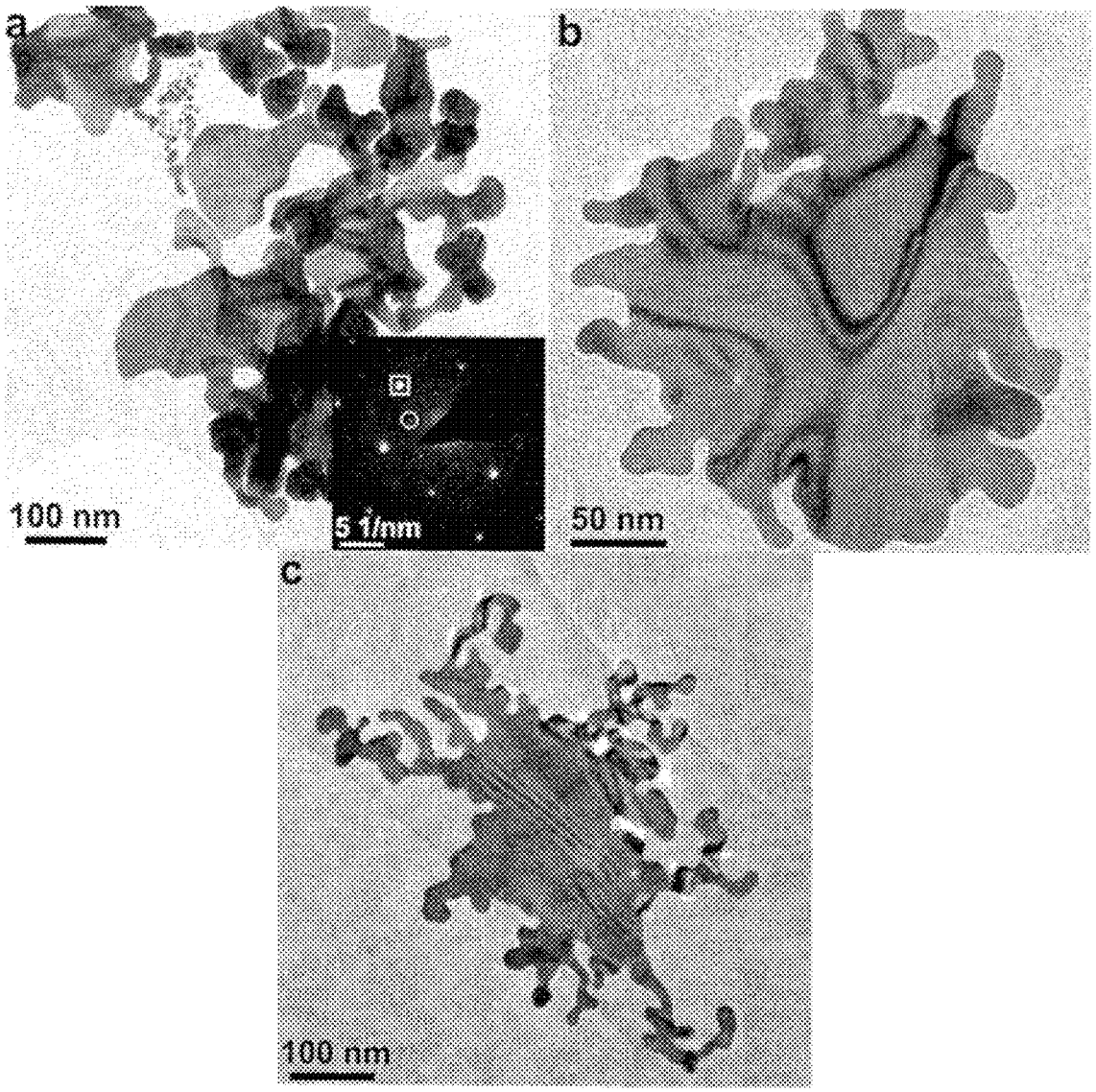

FIG. 9: Representative TEM images of ultra-thin metal nanosheets at various points during the reaction according to Example 1.

Figure 10:
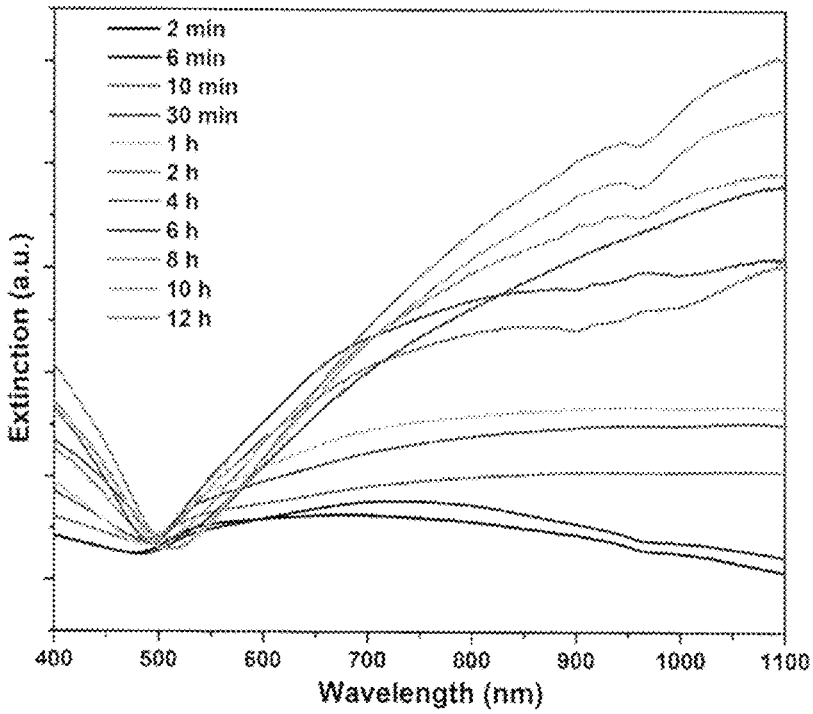

FIG. 10: UV-vis spectra of the reaction mixture at various points during the reaction according to Example 1.

Figure 11:
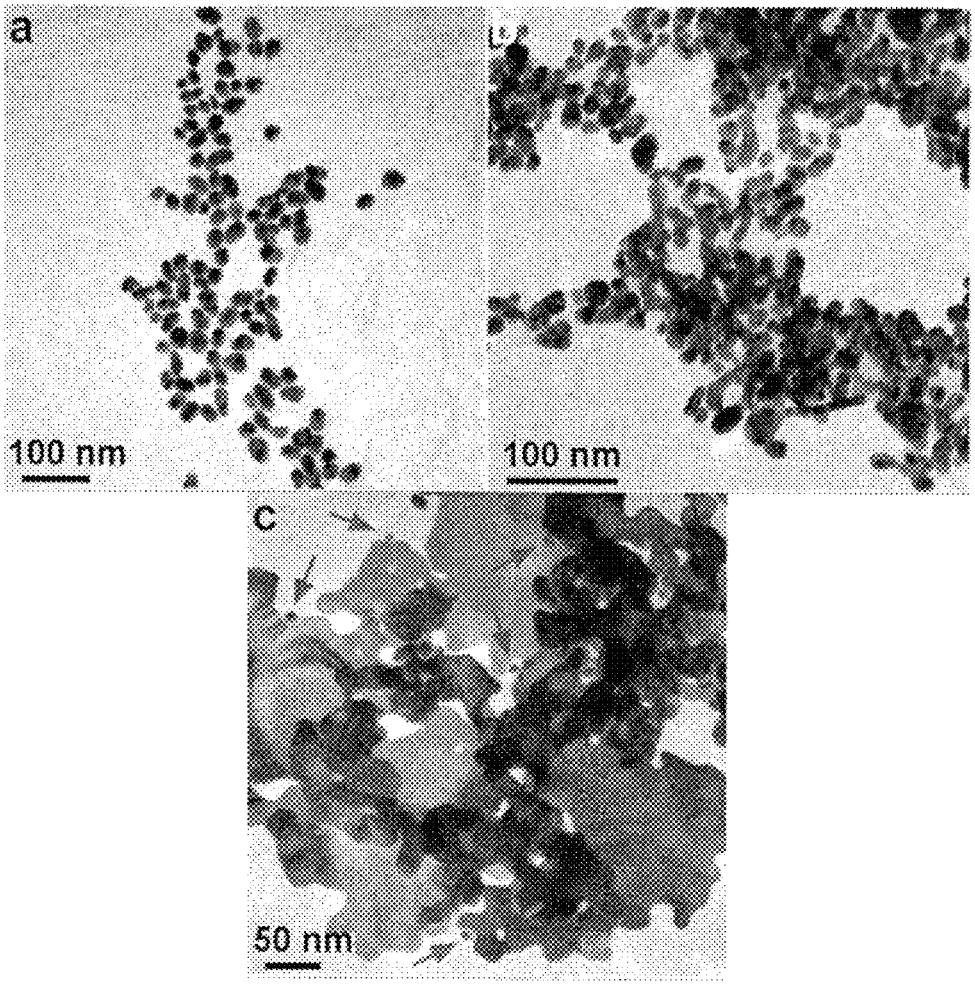

FIG. 11: Representative TEM images of metal nanomaterials formed at different organic compound molar ratios according to Example 2.

Figure 12:
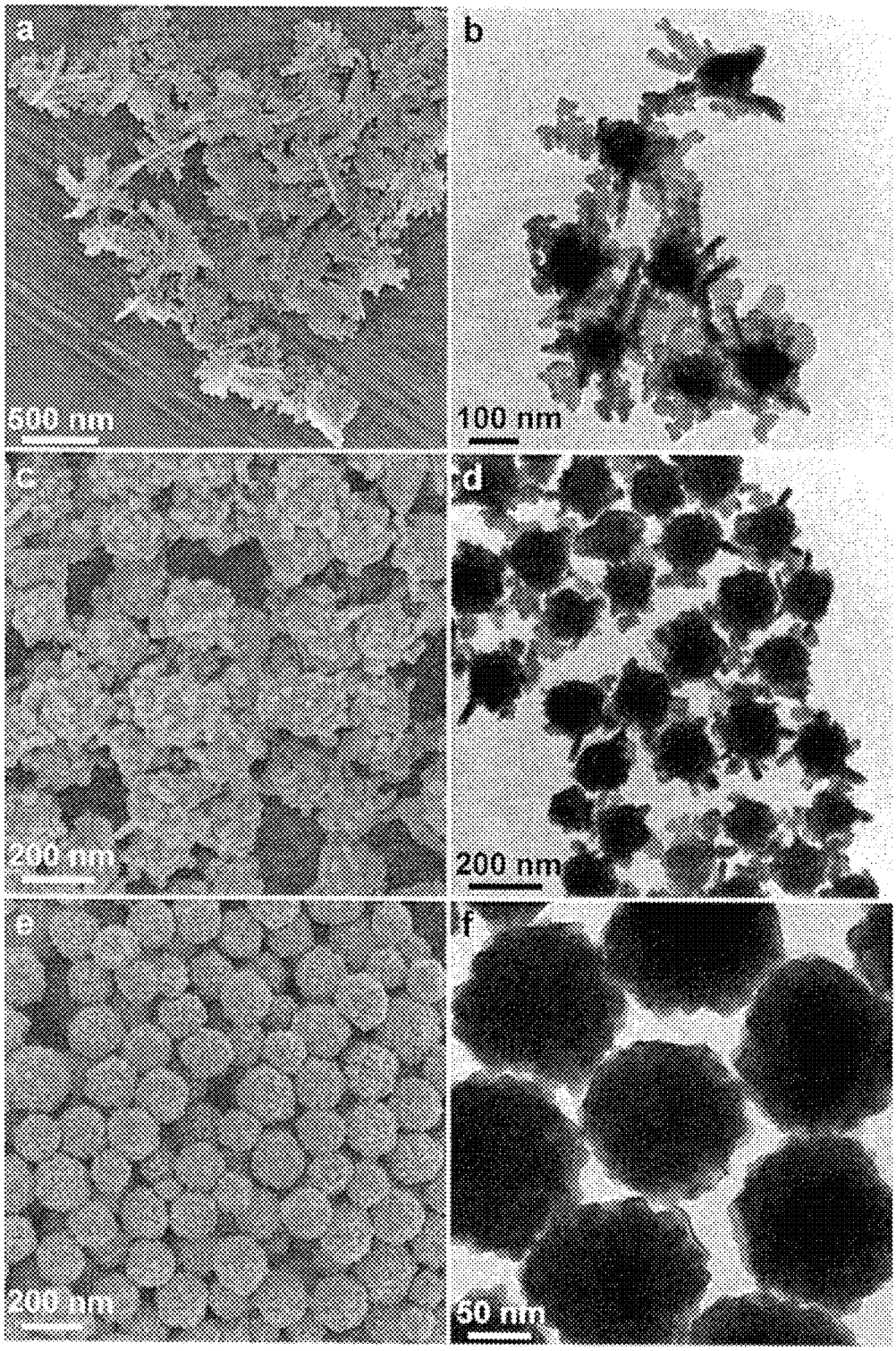

FIG. 12: Representative SEM and TEM images of metal nanomaterials formed at different molar ratios according to Example 2.

Figure 13:
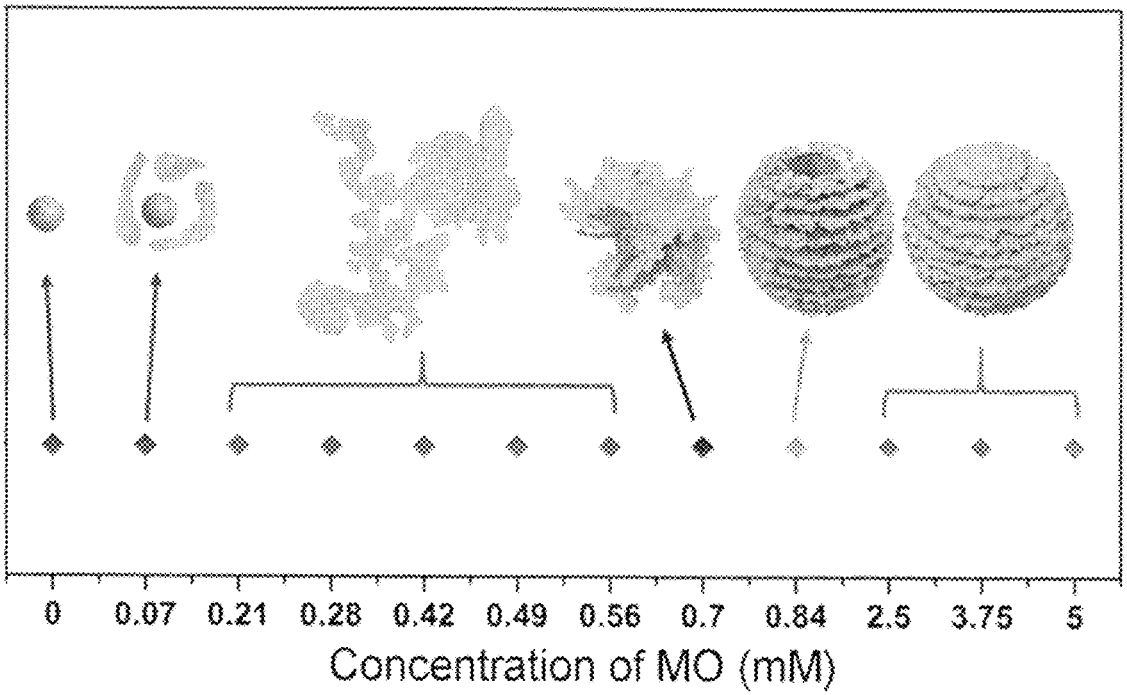

FIG. 13: Schematic representation of the metal nanomaterials synthesised with different molar ratios according to Example 2.

Figure 14:
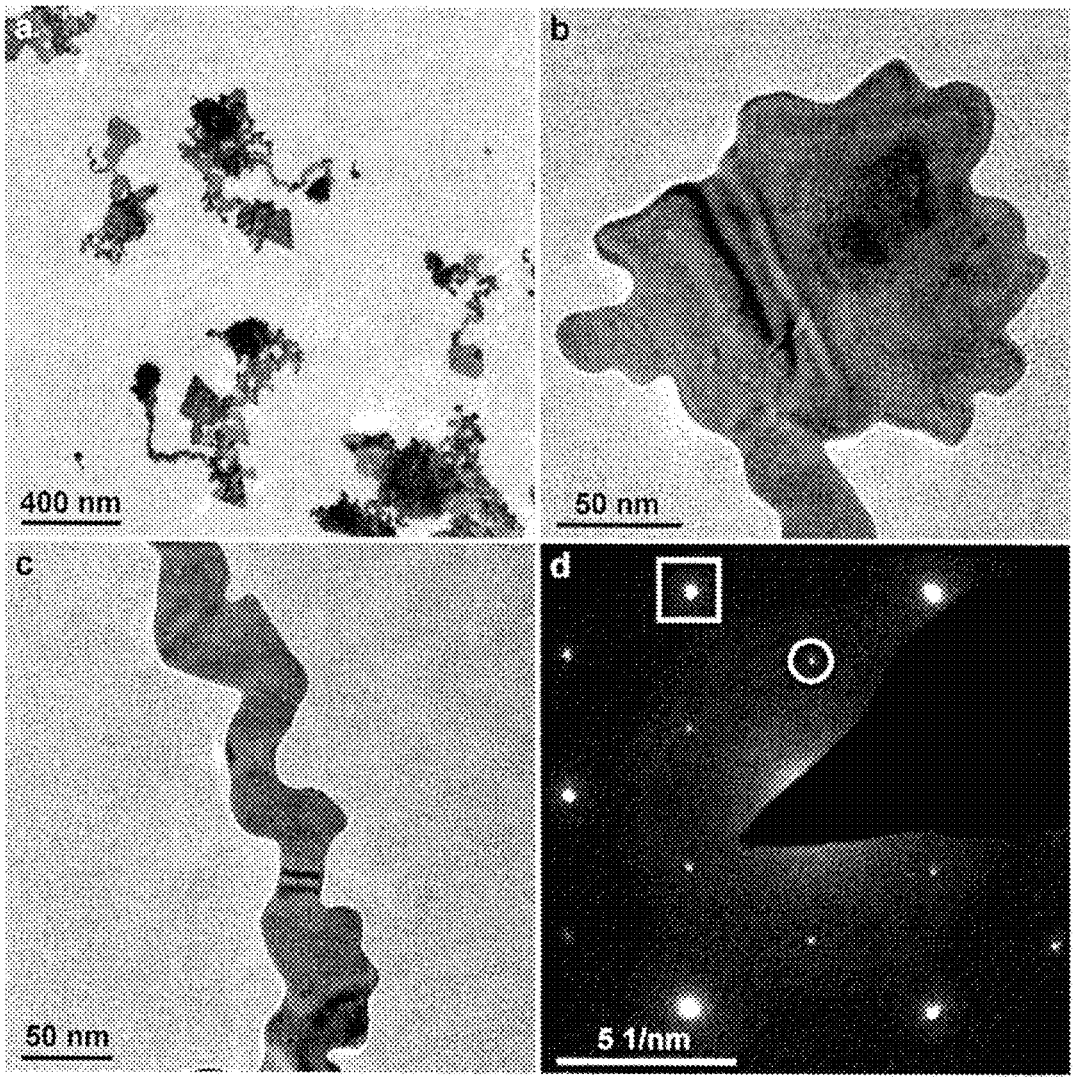

FIG. 14: Representative TEM images and an SAED pattern of metal nanosheets formed with fenaminosulf as the organic compound according to Example 3.

Figure 15:
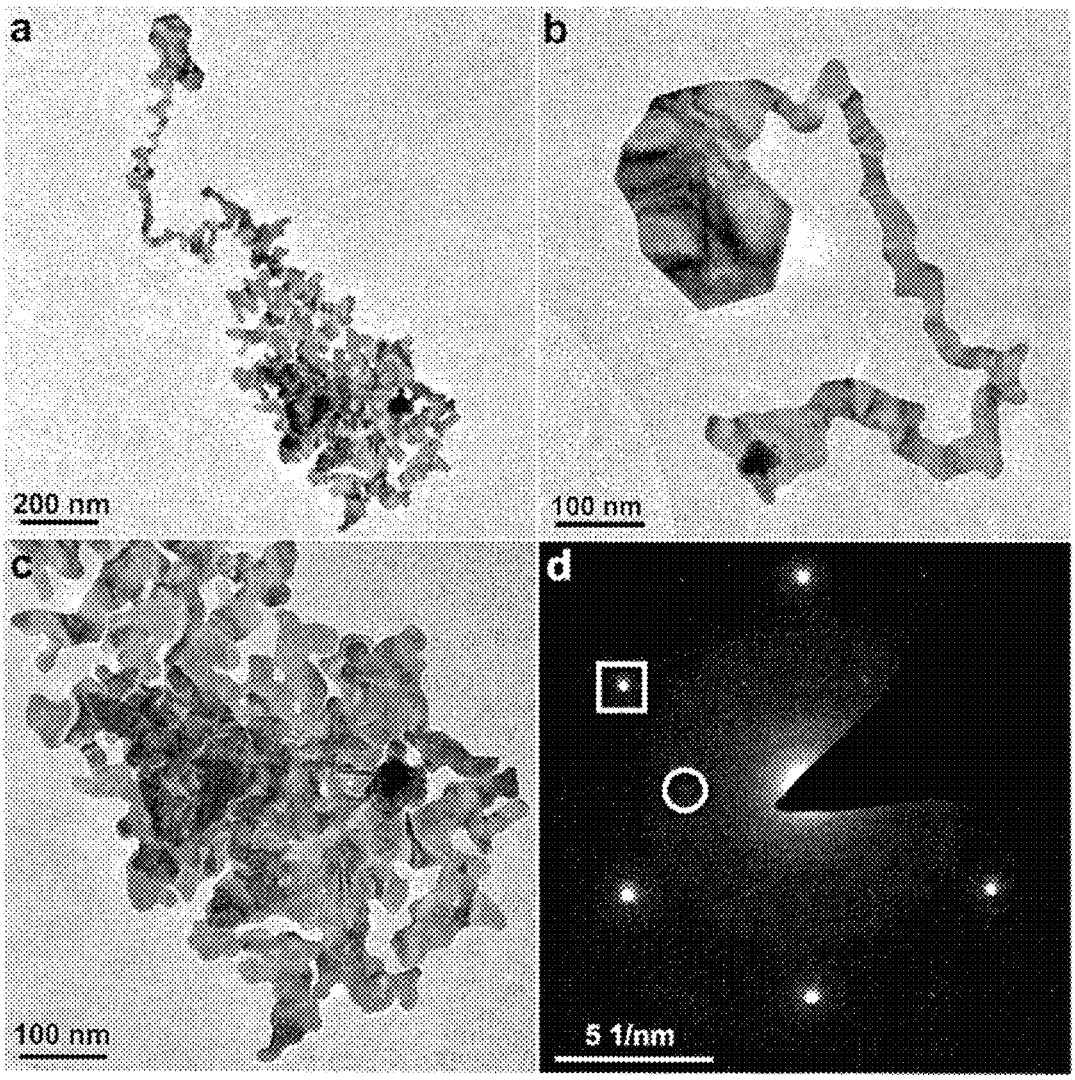

FIG. 15: Representative TEM images and an SAED pattern of metal nanosheets formed with 4-(Dimethylamino) benzoic acid as the organic compound according to Example 4.

Figure 16:
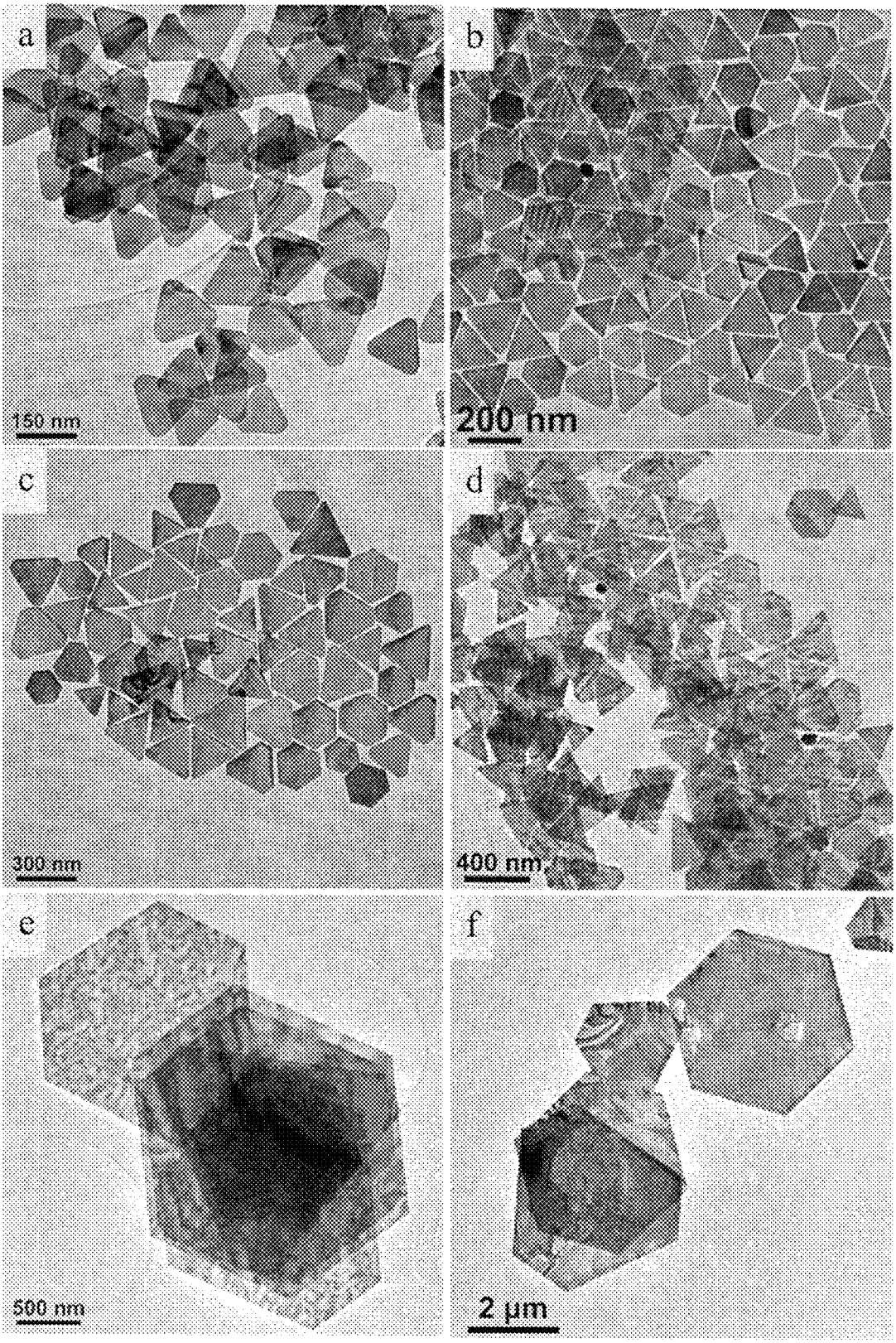

FIG. 16: Representative TEM images of single crystalline metal nanoplates of various sizes formed by addition of an inorganic salt according to Example 5.

Figure 17:
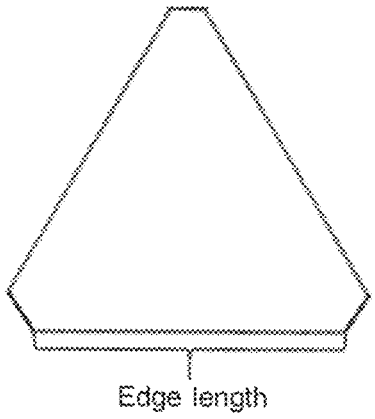

FIG. 17: Schematic representation of a truncated triangular nanoplate formed according to Example 5. The measurement of edge length is shown (where the measured edge is the longest of the three main edges).

Figure 18:
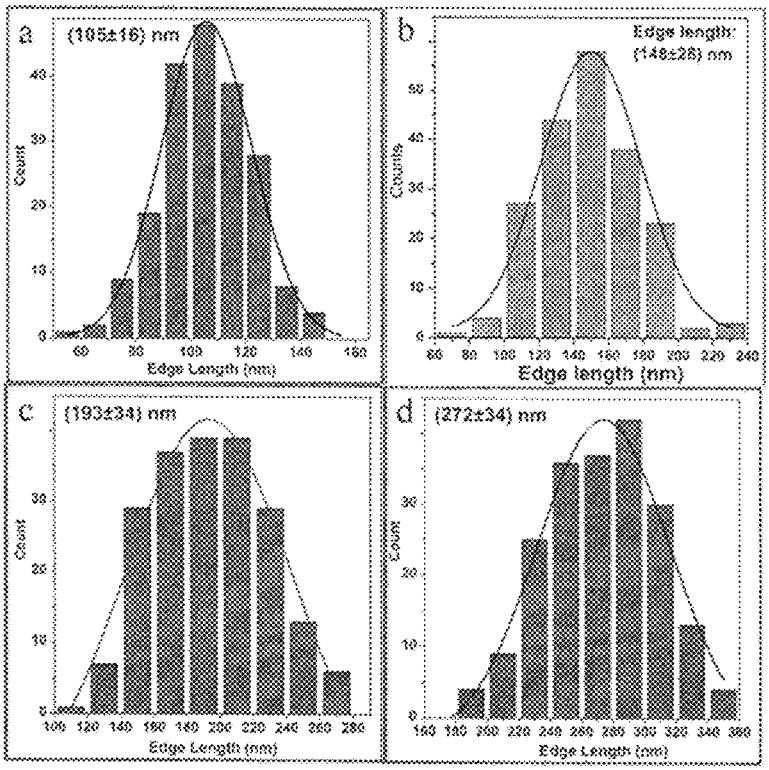

FIG. 18: Histograms of the sizes of metal nanoplates formed with different molar ratios according to Example 5.

Figure 19:
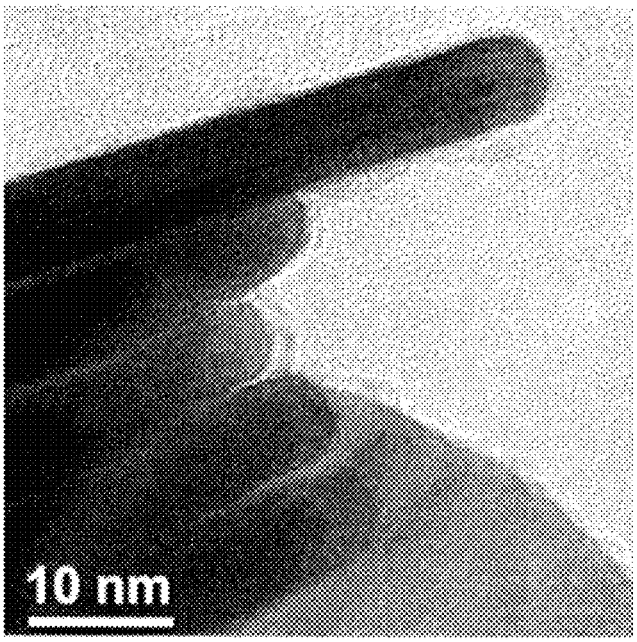

FIG. 19: TEM image of a stack of metal nanoplates from a side perspective formed in the presence of a certain molar ratio of inorganic salt according to Example 5.

Figure 20:
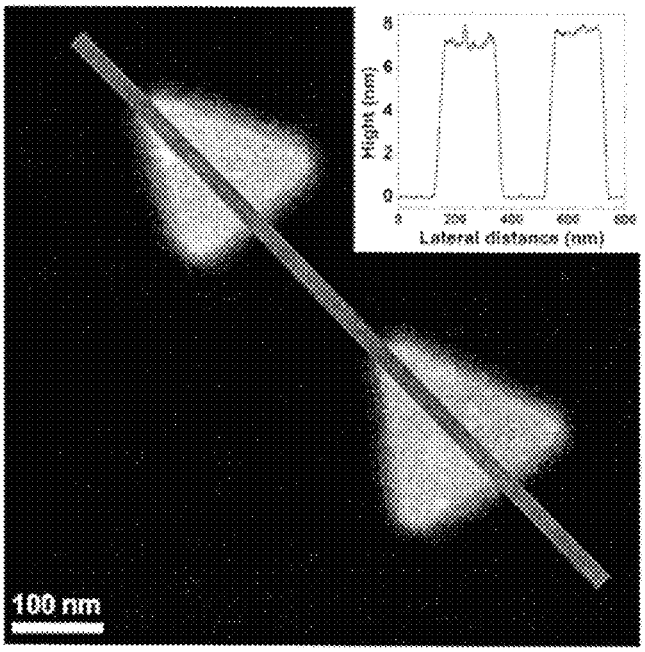

FIG. 20: AFM image and height analysis of two metal nanoplates formed in the presence of a certain molar ratio of inorganic salt according to Example 5.

Figure 21:
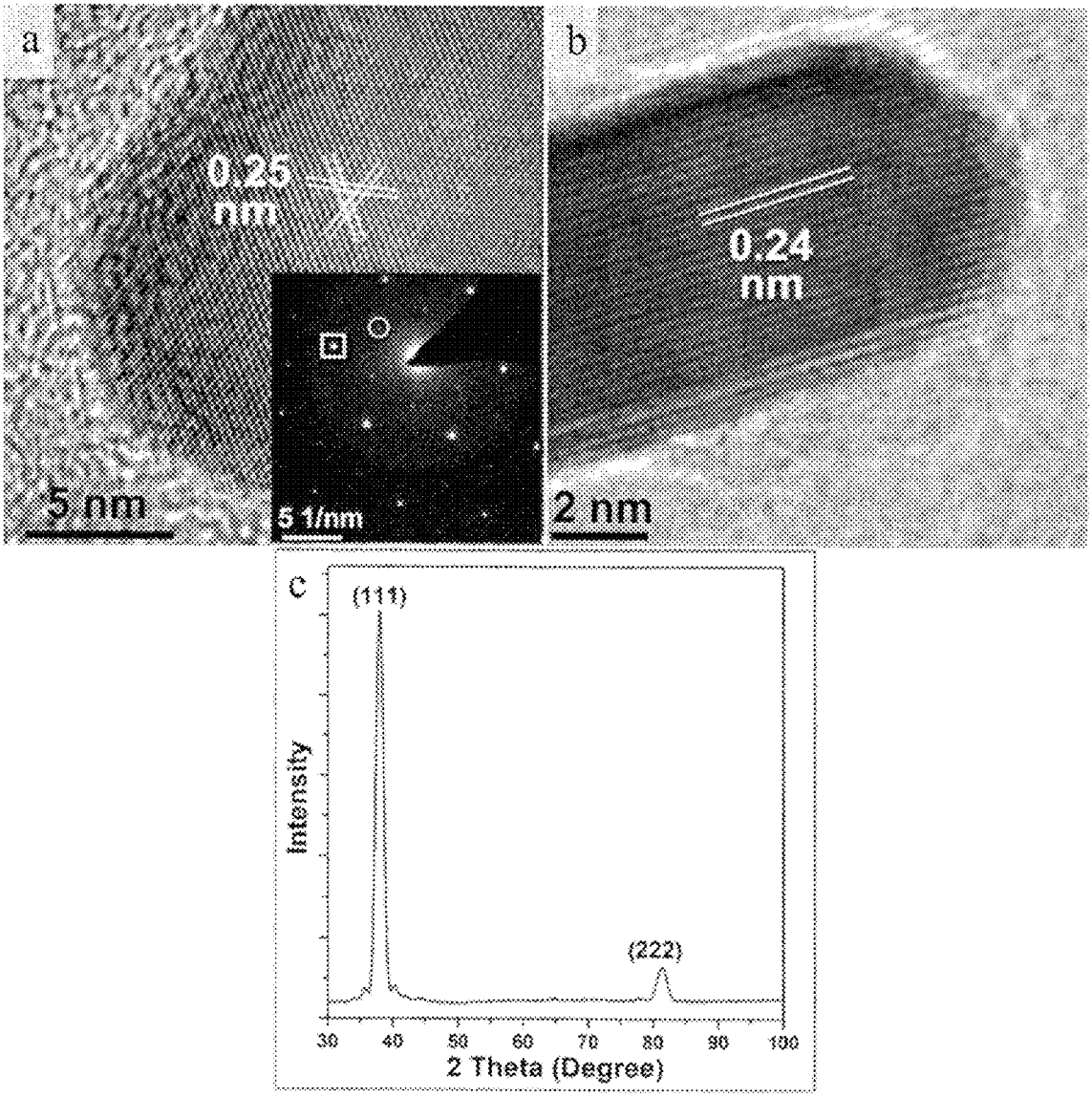

FIG. 21*a-b*: HRTEM images of the top face FIG. 21*a* and side FIG. 21*b* of a metal nanoplate formed in the presence of a certain molar ratio of inorganic salt according to Example 5. The inset of FIG. 21*a* is an SAED pattern in the <111> zone axis.

FIG. 21*c*: XRD pattern over a 2θ range from 30° to 100° of metal nanoplates formed in the presence of a certain molar ratio of inorganic salt according to Example 5.

Figure 22:
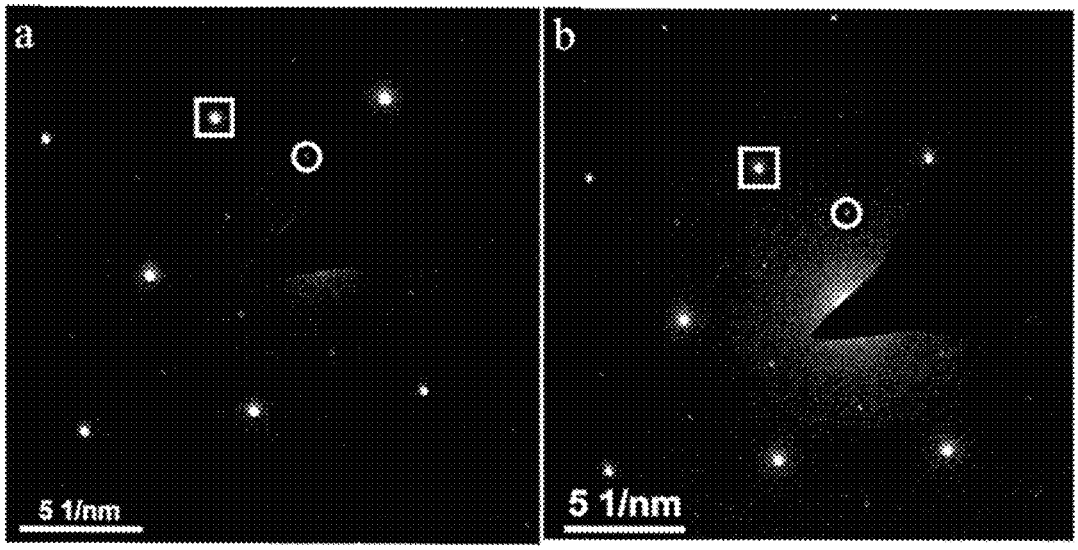

FIG. 22: SAED patterns of larger metal nanoplates formed in the presence of higher molar ratios of inorganic salt according to Example 5.

Figure 23:
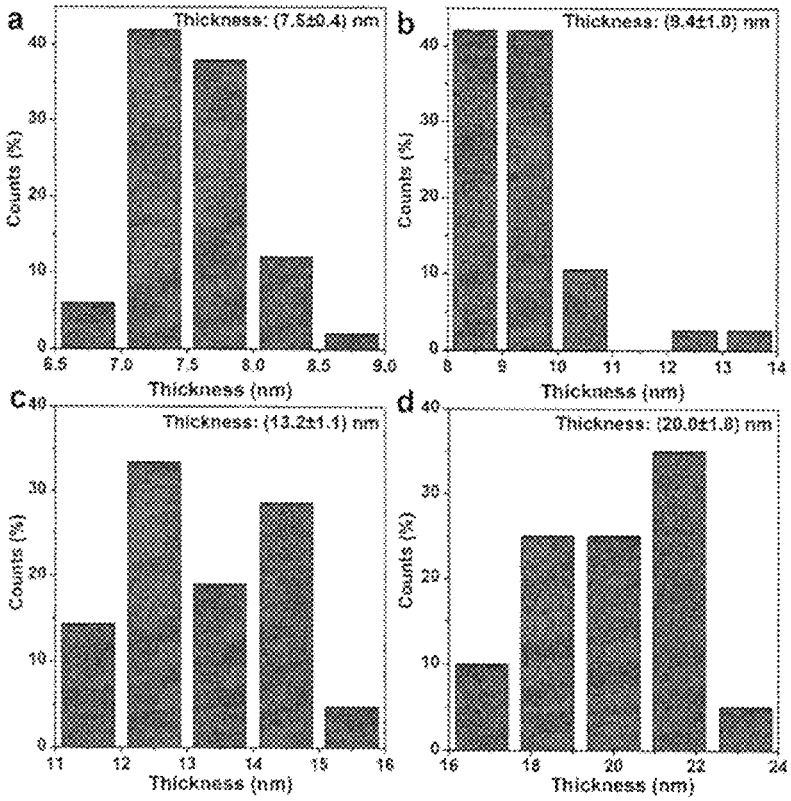

FIG. 23: Histograms and average thickness of metal nanoplates formed in the presence of varying molar ratios of inorganic salt according to Example 5.

Figure 24:
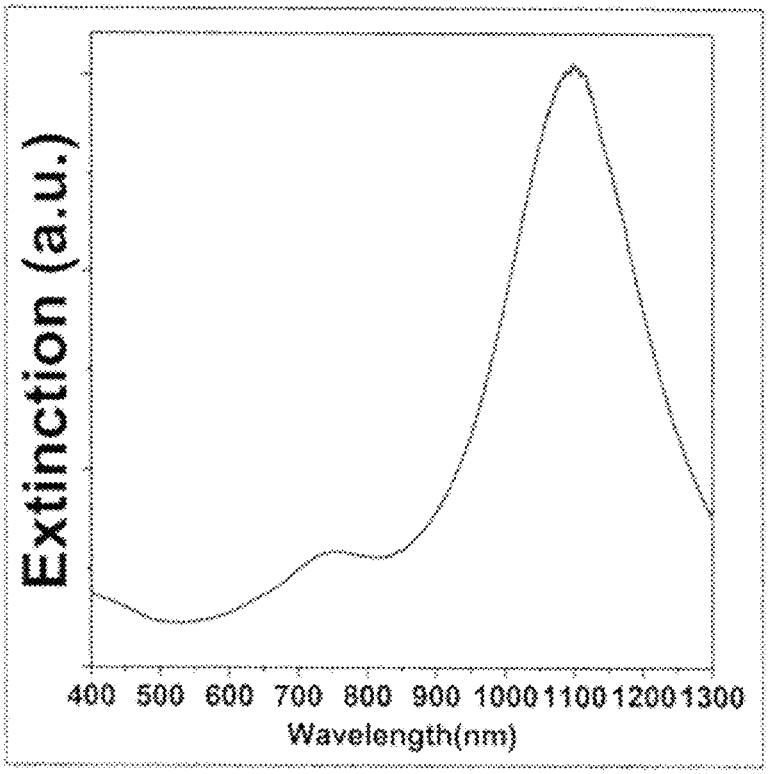

FIG. 24: UV-vis spectrum of metal nanoplates formed in the presence of a certain molar ratio of inorganic salt according to Example 5.

Figure 25:
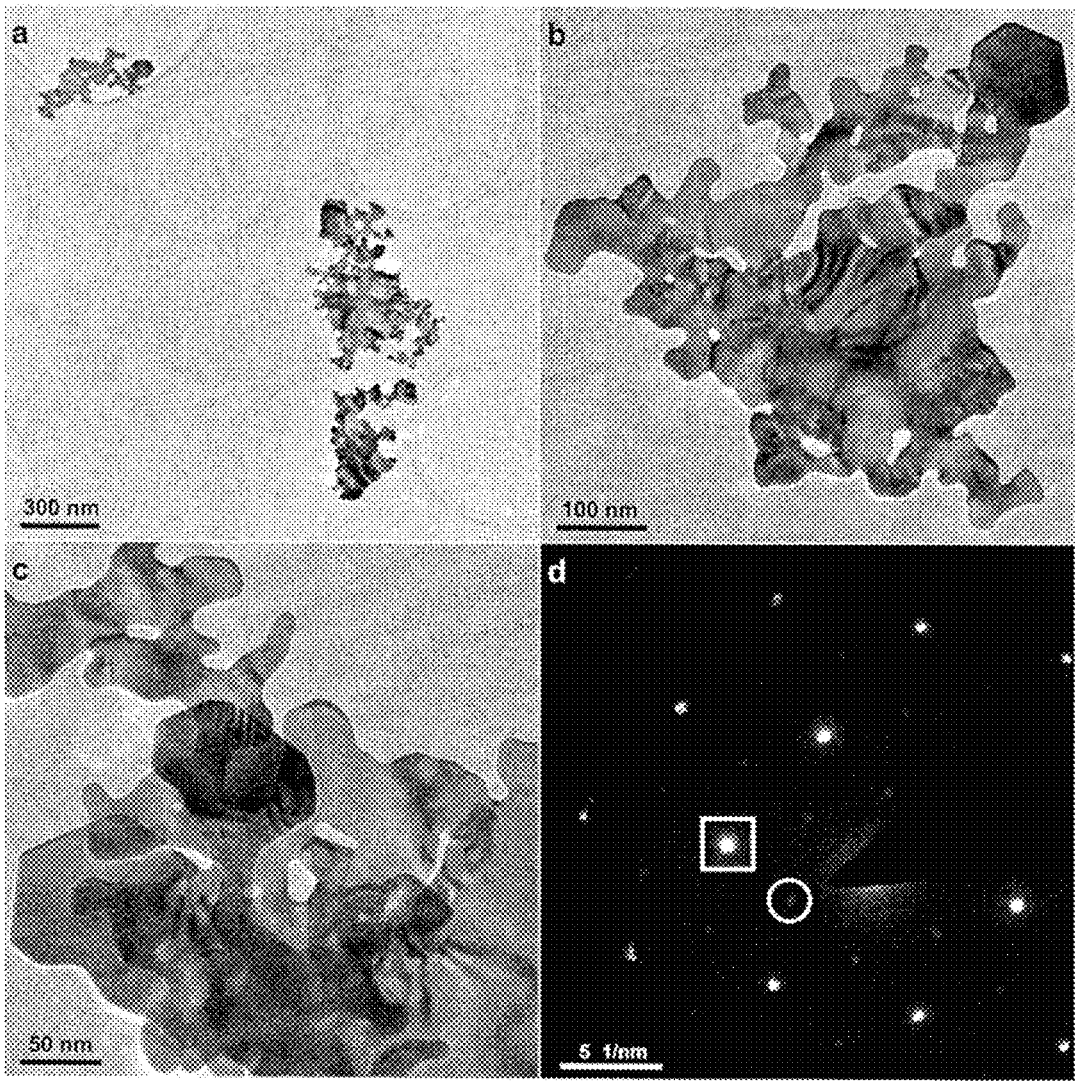

FIG. 25: Representative TEM images and an SAED pattern of metal nanosheets formed with ethyl orange as the organic compound according to Example 7.

Figure 26:
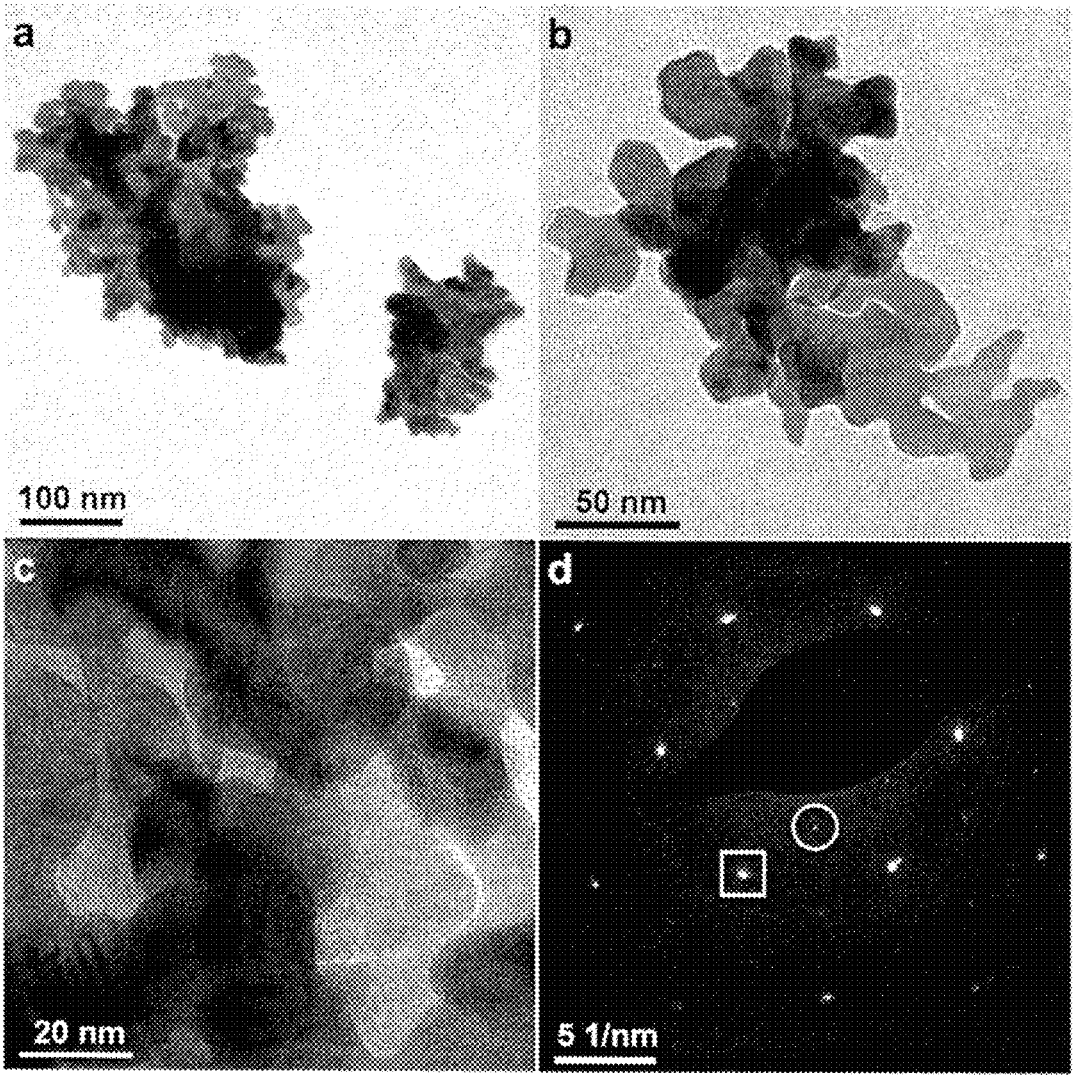

FIG. 26: Representative TEM images and an SAED pattern of metal nanosheets formed with para methyl red as the organic compound according to Example 8.

Figure 27:
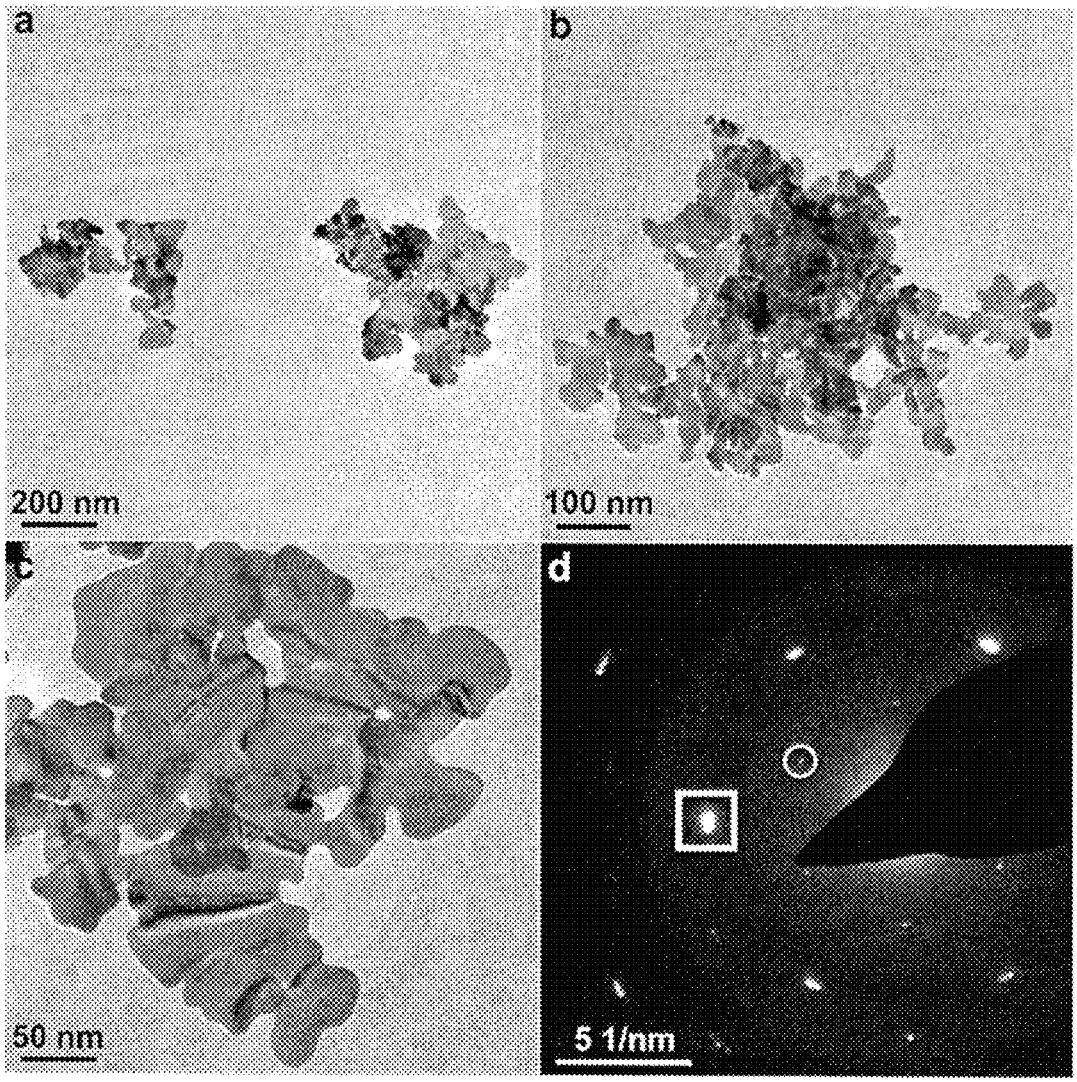

FIG. 27: Representative TEM images and an SAED pattern of metal nanosheets formed with methyl red as the organic compound according to Example 9.

Figure 28:
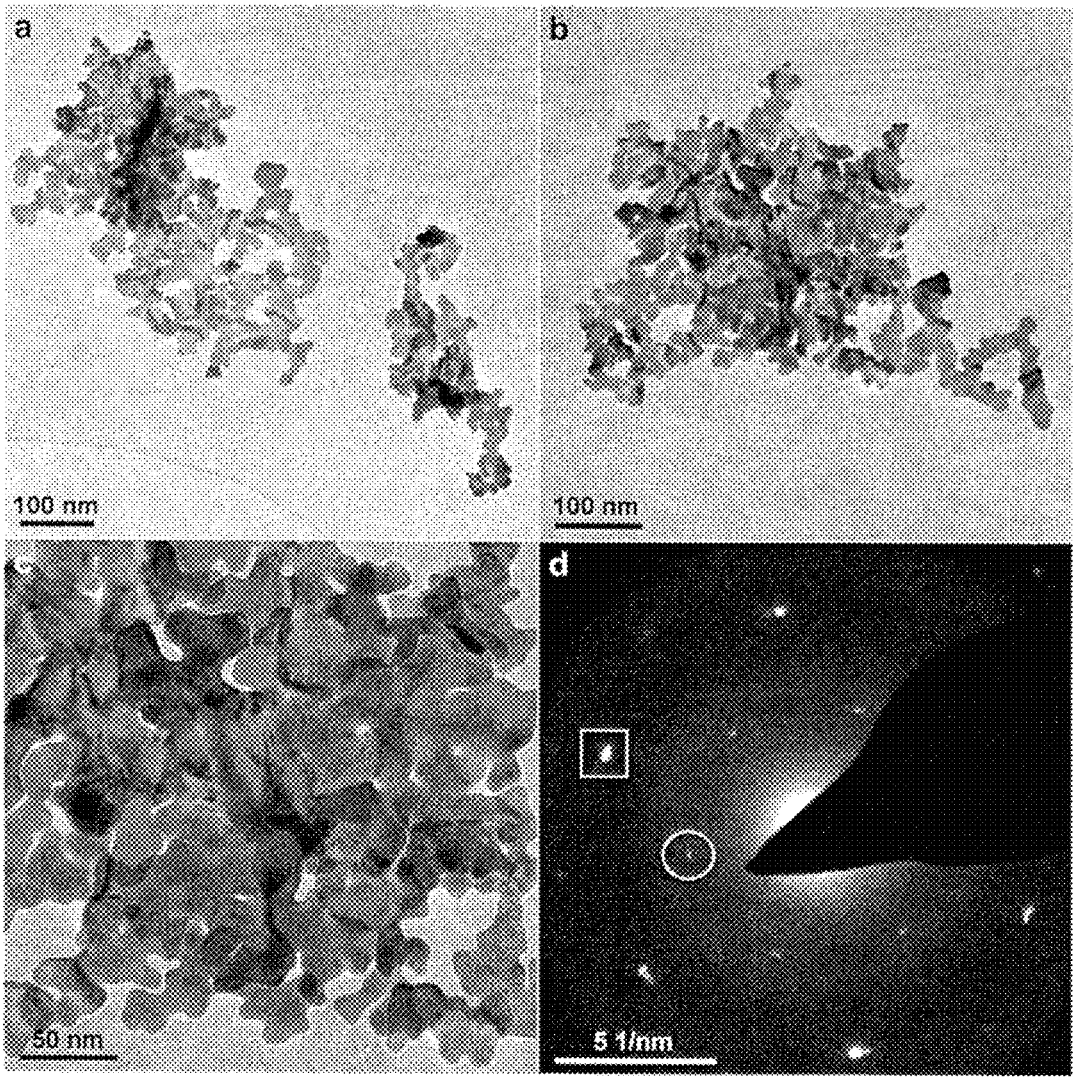

FIG. 28: Representative TEM images and an SAED pattern of metal nanosheets formed with 4-methylamino benzoic acid as the organic compound according to Example 10.

Figure 29:
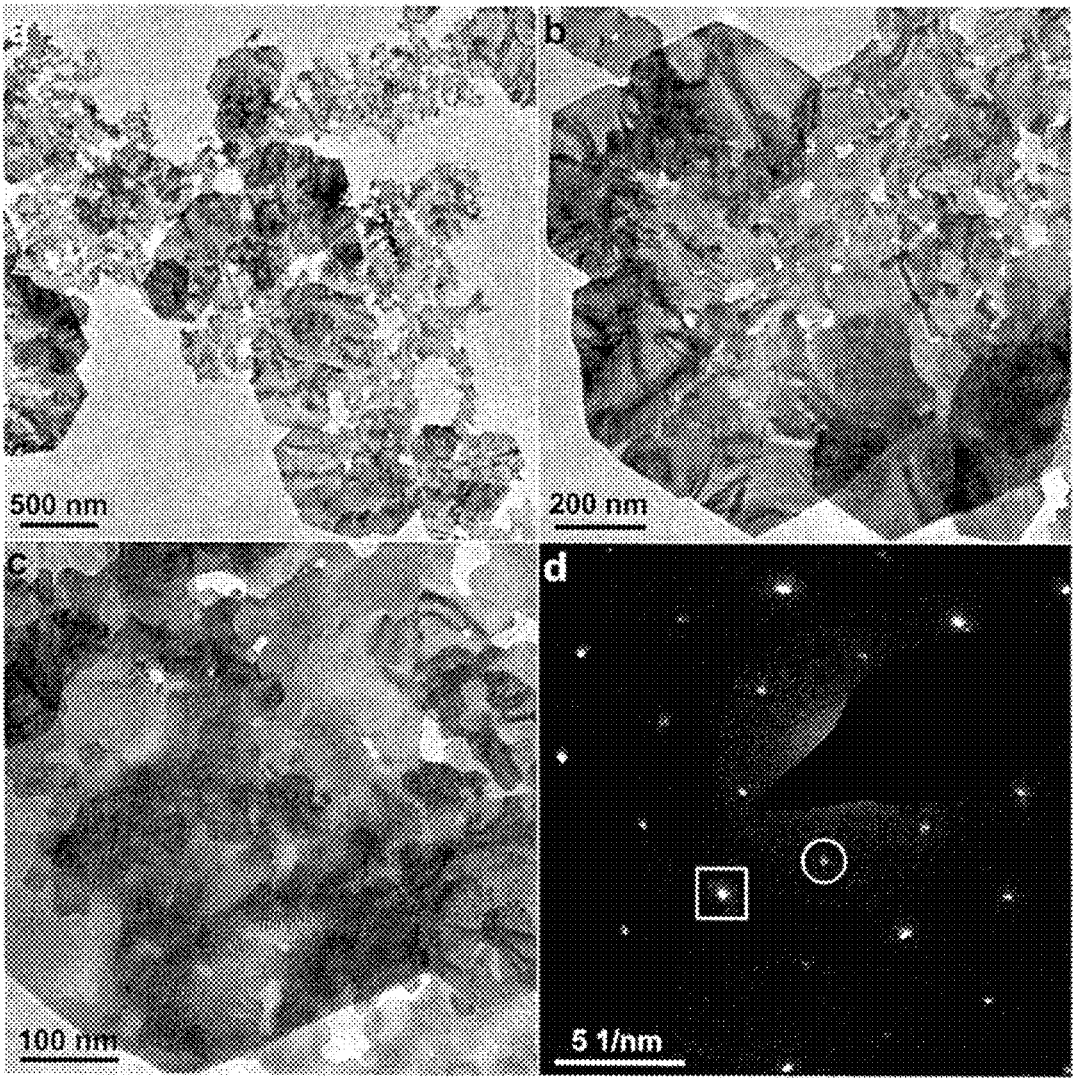

FIG. 29: Representative TEM images and an SAED pattern of metal nanosheets formed with 2,2'-bipyridine as the organic compound according to Example 11.

Figure 30:
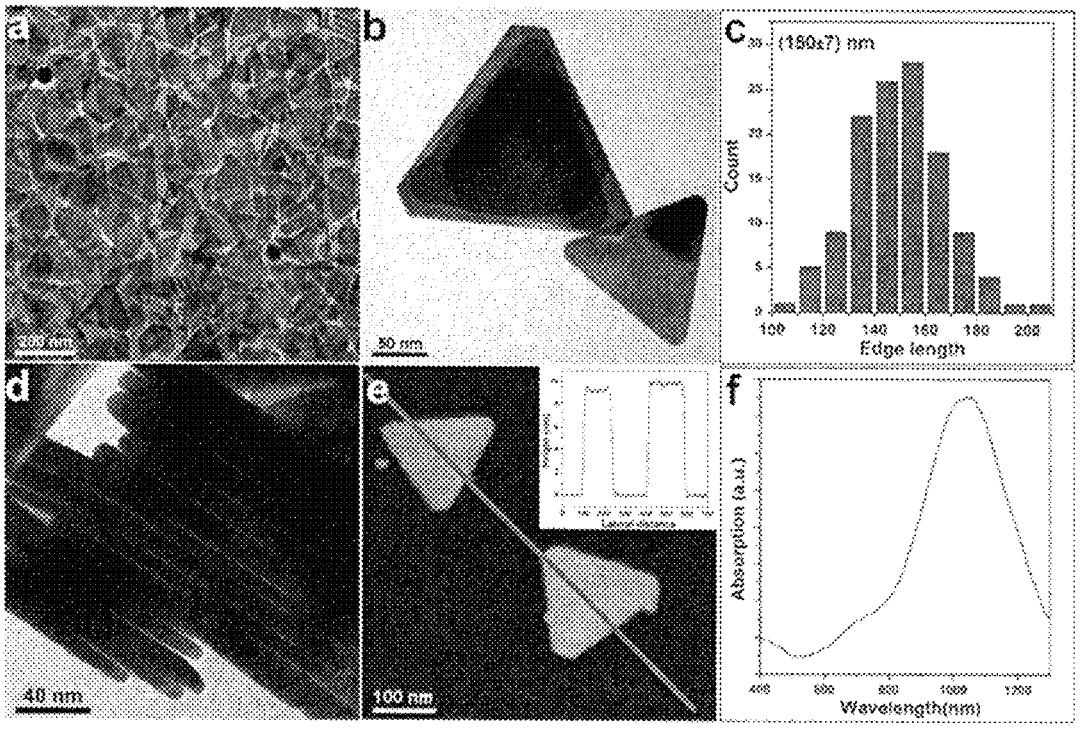

FIG. 30: Representative TEM images, an AFM image, edge length histogram and UV-vis spectrum of nanoplates formed with NaBr as the inorganic salt according to Example 6.

All reagents in the examples were obtained commercially and used without further purification. Ultra-pure water such as Milli-Q® characterised by a resistivity of 18.2 MΩ·cm at 25° C. was used for all experiments. Reaction vessels were cleaned with aqua regia (1:3 $HNO_3$:HCl by volume), thoroughly rinsed with ultra-pure water, dried in an oven and then allowed to cool before use.

EXAMPLE 1: ULTRA-THIN GOLD NANOSHEETS USING METHYL ORANGE AS AN ORGANIC COMPOUND

Synthesis

An aqueous solution (1 mL, 5 mM) of gold chloride ($HAuCl_4$) and a freshly prepared aqueous solution (0.5 mL, 100 mM) of sodium citrate (SC) were added sequentially to an aqueous solution (4 mL, 0.21 mM) of methyl orange (MO) at a temperature of 20° C. The resultant reaction mixture was kept undisturbed at a temperature of 20° C. for 12 hours.

After 12 hours, a blue-green dispersion was obtained. This dispersion remained stable under ambient conditions for longer than 15 months. FIG. 3 shows the UV-vis spectrum of the reaction solution after 12 hours. The UV-vis spectrum exhibits a broad excitation band in the region of 500-1300 nm. The lack of a distinct peak around 520 nm indicates the absence of isotropic gold nanoparticles.

The reaction products were collected by centrifugation at a relative centrifugal field (RCF) of 1000 g for a period of 10 minutes. The reaction product pellet was then washed several times with water until the supernatant was colourless. The pellet was then redispersed in water for further analysis.

Characterisation

Transmission electron microscopy (TEM) and scanning transmission electron microscopy (STEM) images of the ultra-thin nanosheets were collected. Bright field TEM images were taken using a Tecnai F20 TEM/STEM operated at an accelerating voltage of 200 kV, equipped with a field emission gun using an extraction voltage of 4.5 kV, an Oxford Instruments 80 $mm^2$ SD detector running Aztec software and a Gatan Orius CCD camera running Digital Micrograph software. Dark field STEM images were collected using a FEI Titan3 Themis G2 S/TEM operated at 300 kV equipped with a monochromator, FEI SuperX EDX detectors, a Gatan Quantum ER 965 imaging filter and a Gatan OneView CCD camera running GMS 3.1.

TEM and STEM samples were prepared by dropping 5 μL of the redispersed gold nanosheet solution onto a carbon-coated copper grid (Agar Scientific Ltd) which was dried naturally at room temperature.

FIG. 4*a* shows a representative bright field TEM image which reveals the high-yield formation of 2D nanosheets. Detailed analysis of TEM images of 20 individual nanosheets shown in FIG. 5 reveals that they have similar fractal dimensions with values within the range 1.69-1.78. The fractal dimension calculation was performed using the FDC software (Paul Bourke, http://paulbourke.net/fractals/fracdim/) by adjusting the contrast of images such that the algorithm correctly identifies the whole shape of each individual nanosheet.

FIG. 4*b* is a higher magnification bright field TEM image which shows that the nanosheet exhibits bend contours. This suggests that they are flexible. FIG. 4*c* is a representative dark field STEM image showing the translucent appearance, folded edges and wrinkles of nanosheets. This is indicative of their ultra-thin nature.

AFM height measurements were used to determine the thickness of the ultra-thin gold nanosheets. The samples were imaged on a Dimension FastScan Bio AFM (Bruker, Billerica MA) using tapping mode at room temperature in air with FastScan-A cantilever probes (Bruker, Camarillo CA). Accurate calibration of the Z-piezo was confirmed by measuring the depth of pits on HF-etched muscovite mica. The terraces created by HF-etching are 1.00 nm high which represents half the c-axis spacing of the monoclinic unit cell. HF mica was prepared by incubating freshly cleaved mica sheets in 40% HF for 4 hours. The HF was neutralised in an excess of sodium bicarbonate and ultra-pure water before imaging. 2 μL of the redispersed gold nanosheet solution was deposited onto freshly cleaved muscovite mica and left at room temperature which allowed the water to evaporate. Images were typically acquired at scan sizes of 1 to 5 μm with a resolution of 2048×2048 pixels at 10.5 Hz scan rate. The cantilever was automatically tuned to 5% below resonance to operate in tapping mode (typical resonant frequency of 1400 kHz). Analysis of nanosheet heights were performed in Gwyddion software using the line profile function set to a line width of 5 pixels.

FIG. 6 shows an AFM image of nanosheets 1 to 5 with insets showing thickness profiles measured along the indicated white lines for nanosheets 1 to 3. The average thicknesses of nanosheets 1-5 were 0.50 nm, 0.53 nm, 0.44 nm, 0.48 nm and 0.50 nm respectively. FIG. 7 shows a histogram of nanosheet thickness with data from 30 nanosheets showing an average nanosheet thickness of 0.42±0.05 nm.

The crystal structure of the ultra-thin nanosheet was investigated using high-resolution transmission electron microscopy (HRTEM), selected area diffraction (SAED) and X-ray diffraction (XRD). HRTEM images were taken using a FEI Titan3 Themis G2 S/TEM operated at 300 kV equipped with a monochromator, FEI SuperX EDX detectors, a Gatan Quantum ER 965 imaging filter and a Gatan OneView CCD camera running GMS 3.1. SAED patterns were collected using a Tecnai F20 TEM/STEM operated at an accelerating voltage of 200 kV, equipped with a field emission gun using an extraction voltage of 4.5 kV, an Oxford Instruments 80 $mm^2$ SD detector running Aztec software and a Gatan Orius CCD camera running Digital Micrograph software. XRD patterns were obtained using a Bruker D8 X-ray diffractometer with Cu Ku source and an X'cellerator detector. A continuous scan over a 2θ range from 20° to 90° was performed with an acquisition time of 1 hour per sample at a step size of 0.05°.

HRTEM and SAED samples were prepared by dropping 5 μL of the redispersed gold nanosheet solution onto a carbon-coated copper grid (Agar Scientific Ltd) which was dried at room temperature naturally. XRD samples were prepared by depositing and drying slurries directly on low-background Si sample holders.

FIG. 8*a* shows a HRTEM image of the ultra-thin gold nanosheet. The crystal structure of the nanosheet exhibits a 6-fold symmetric structure with a lattice spacing of 0.25 mn. This is consistent with the ⅓ {422} lattice spacing of fcc-gold.

FIG. 8*b* shows the SAED pattern down the <111> zone axis of the ultra-thin gold nanosheet. The SAED pattern displays two sets of 6-fold symmetric spots which included strong spots (boxed) identified as the allowed {220} Bragg reflection (corresponding to the lattice spacing of 0.144 nm) and weak spots (circled) identified as forbidden ⅓ {422} reflection (corresponding to the lattice spacing of 0.250 nm). The presence of this forbidden reflection is ascribed to local regions of incomplete cubic (ABC) packing derived from the ultra-thin nature, as well as local hexagonal close packing (hcp).

FIG. 8*c* shows the XRD pattern of the ultra-thin gold nanosheet. The XRD pattern shows a dominant (111) peak at 38.2°, revealing that <111> oriented fcc Au crystals are predominant in the nanosheet sample. In addition to the main Bragg reflections of fcc Au, shoulders at ≈37° and ≈40° can be assigned respectively to the (002) and (101) lattice spacings of an Au hcp phase.

Both HRTEM and SAED results show the single-crystalline nature of the Au nanosheet with a <111> orientation. Hence according to the thickness measured by AFM, the Au nanosheet contains 2 to 3 Au atomic layers.

The growth mechanism of the ultra-thin Au nanosheet was investigated by characterising reaction products at different stages of the reaction by TEM and UV-vis. TEM images were collected using a Tecnai G2 Spirit TWIN/BioTWIN at an acceleration voltage of 120 kV. TEM samples were prepared as described for other measurements. UV-vis spectra were recorded with a Perkin Elmer UV/VIS/NIR Lambda 19 spectrophotometer.

FIGS. 9*a*, 9*b* and 9*c* show TEM images of the reaction product after 2 mins, 10 mins and 20 mins of reaction respectively (the start point of the reaction is defined as when the sodium citrate was added). The products collected at 2 minutes included nanoflakes of varied lateral dimensions. This suggests that 2D Au nanostructures were formed at an early stage of the reaction. A SAED pattern (inset of FIG. 9*a*) collected after 2 minutes of reaction demonstrates that these nanoflakes are <111> oriented.

FIG. 10 shows UV-vis spectra of the reaction mixture collected at various points during the reaction. The UV-vis spectrum displays a wide absorption in the near-infrared (NIR) region coupled with a shoulder at around 550 nm, evidencing the formation of anisotropic nanostructures in agreement with TEM observations.

With increasing reaction time (FIGS. 9*b* and 9*c*), the lateral dimension of the product increases and the shape assumes a branched fractal structure. In the UV-vis spectrum FIG. 10, the absorption in the NIR region becomes gradually enhanced and reached a maximum at around 12 hours. This indicates the completion of the reaction. The fractal dimensions of the nanosheets shown in FIG. 5 are close to 1.71 which would suggest formation via a diffusion-limited aggregation pathway.

EXAMPLE 2: CONTROLLED SYNTHESIS OF DIFFERENT NANOSTRUCTURES BY VARYING THE MOLAR RATIO OF ORGANIC COMPOUND TO THE SOURCE OF NOBLE METAL IONS

Synthesis

An aqueous solution (1 mL, 5 mM) of gold chloride ($HAuCl_4$) and a freshly prepared aqueous solution (0.5 mL, 100 mM) of sodium citrate (SC) were sequentially added to an aqueous solution (4 mL, varying concentration—see Table 1) of methyl orange (MO) at a temperature of 20° C. The resultant reaction mixture was kept undisturbed at a temperature of 20° C. for 12 hours.

After 12 hours, the reaction products were collected by centrifugation at a relative centrifugal field (RCF) of 1000 g for a period of 10 minutes. The product pellets were then washed several times with water until the supernatant was colourless. The pellets were then redispersed in water for further analysis.

Characterisation

TEM images of the reaction products at different molar ratios were taken. TEM samples were prepared as described in Example 1. TEM images were taken using a Tecnai F20 TEM/STEM operated at an accelerating voltage of 200 kV, equipped with a field emission gun using an extraction voltage of 4.5 kV, an Oxford Instruments 80 $mm^2$ SD detector running Aztec software and a Gatan Orius CCD camera running Digital Micrograph software.

FIG. 11 shows representative TEM images of the different nanostructures formed at the lower molar ratios of 0.000 (FIG. 11*a*), 0.056 (FIG. 11*b*) and 0.112 (FIG. 11*c*). FIG. 12 shows representative TEM images of the different nanostructures formed at higher molar ratios of 0.56 (FIG. 12*b*), 0.672 (FIG. 12*d*) and 2 (FIG. 12*f*).

Scanning electron microscopy (SEM) images of the reaction products at different molar ratios were taken. SEM images were obtained using a Hitachi SU8230 at a voltage of 2 kV. Each SEM sample was prepared by placing 5 μL of the redispersed solution onto an aluminium substrate and drying at room temperature naturally.

FIG. 12 shows representative SEM images of the different nanostructures formed with molar ratios of 0.56 (FIG. 12*a*), 0.672 (FIG. 12*c*) and 2 (FIG. 12*e*).

Table 1 summarises the types of nanomaterial formed at different molar ratios based on the corresponding TEM and SEM images shown in FIG. 11 and FIG. 12. A schematic representation of the products synthesised with different molar ratios is shown in FIG. 13.

TABLE 1

Types of nanostructure formed at different molar ratios

| MO concentration/mM | MO:$HAuCl_4$ molar ratio | Type of nanostructure | Corresponding TEM image | Corresponding SEM image |
|---|---|---|---|---|
| 0.0 | 0 | Nanoparticle | FIG. 11a | |
| 0.07 | 0.056 | Nanoparticles/flakes | FIG. 11b | |
| 0.14 | 0.112 | Nanoflakes/particles | FIG. 11c | |
| 0.70 | 0.56 | Aggregated nanosheets | FIG. 12b | FIG. 12a |
| 0.84 | 0.672 | Quasi-spheres | FIG. 12d | FIG. 12c |
| 2.50 | 2 | Quasi-spheres | FIG. 12f | FIG. 12e |

EXAMPLE 3: SYNTHESIS OF METAL NANOSTRUCTURES USING FENAMINOSULF

Synthesis

Fenaminosulf differs from methyl orange as it has only one aromatic ring (see FIG. 2). However it still possesses a rigid aromatic moiety and hydrophilic and hydrophobic moieties.

An aqueous solution (1 mL, 5 mM) of gold chloride ($HAuCl_4$) and a freshly prepared aqueous solution (0.5 mL, 100 mM) of sodium citrate (SC) were sequentially added to an aqueous solution (4 mL, 0.21 mM) of fenaminosulf at a temperature of 20° C. The resultant reaction mixture was kept undisturbed at a temperature of 20° C. for 12 hours.

After 12 hours, the reaction products were collected by centrifugation at a relative centrifugal field (RCF) of 1000 g for a period of 10 minutes. The reaction product pellet was then washed several times with water until the supernatant was colourless. The pellet was then redispersed in water for further analysis.

Characterisation

TEM images and SAED patterns of the reaction products were taken. TEM and SAED samples were prepared as described for Example 1. TEM images shown in FIG. 14*b-c* were taken using a Tecnai F20 TEM/STEM operated at an accelerating voltage of 200 kV, equipped with a field emission gun using an extraction voltage of 4.5 kV, an Oxford Instruments 80 $mm^2$ SD detector running Aztec software and a Gatan Onus CCD camera running Digital Micrograph software. The TEM image shown in FIG. 14*a* was collected using a Tecnai G2 spirit TWIN/BioTWIN at an acceleration voltage of 120 kV. The SAED pattern shown in FIG. 14*d* was collected using a Tecnai F20 TEM/STEM operated at an accelerating voltage of 200 kV, equipped with a field emission gun using an extraction voltage of 4.5 kV, an Oxford Instruments 80 $mm^2$ SD detector running Aztec software and a Gatan Onus CCD camera running Digital Micrograph software.

FIG. 14*a-c* shows bright field TEM images at different magnification of the metal nanostructures formed by using fenaminosulf as the organic compound. These Figures demonstrate the high yield formation of 2D metal nanostructures when using a different organic compound which fulfils the requirements of the present invention. FIG. 14*d* shows an SAED pattern of the metal nanostructures down the <111> zone axis. The strong spots (boxed) are indexed as the allowed {220} Bragg reflection (corresponding to a lattice spacing of 0.144 nm) and the weak spots (circled) are indexed as the forbidden ⅓ {422} reflections (corresponding to a lattice spacing of 0.250 nm). This indicates a <111> oriented 2D gold nanostructure with an atomically flat surface as described in Example 1. These results show that using fenaminosulf at the same molar ratio as methyl orange (Example 1) results in the formation of similar ultra-thin metal nanosheets.

EXAMPLE 4: SYNTHESIS OF METAL NANOSTRUCTURES USING 4-(DIMETHYLAMINO) BENZOIC ACID

Synthesis

An aqueous solution (1 mL, 5 mM) of gold chloride ($HAuCl_4$) and a freshly prepared aqueous solution (0.5 mL, 100 mM) of sodium citrate (SC) were sequentially added to an aqueous solution (4 mL, 0.32 mM) of 4-(Dimethylamino) benzoic acid at a temperature of 20° C. The resultant reaction mixture was kept undisturbed at a temperature of 20° C. for 12 hours.

After 12 hours, the reaction products were collected by centrifugation at a relative centrifugal field (RCF) of 1000 g for a period of 10 minutes. The reaction product pellet was then washed several times with water until the supernatant was colourless. The pellet was then redispersed in water for further analysis.

Characterisation

TEM images and SAED patterns of the reaction products were taken. TEM and SAED samples were prepared as described in Example 1. TEM images shown in FIG. 15*a-c* were taken using a Tecnai F20 TEM/STEM operated at an accelerating voltage of 200 kV, equipped with a field emission gun using an extraction voltage of 4.5 kV, an Oxford Instruments 80 $mm^2$ SD detector running Aztec software and a Gatan Orius CCD camera running Digital Micrograph software. The SAED pattern shown in FIG. 15*d* was collected using a Tecnai F20 TEM/STEM operated at an accelerating voltage of 200 kV, equipped with a field emission gun using an extraction voltage of 4.5 kV, an Oxford Instruments 80 $mm^2$ SD detector running Aztec software and a Gatan Orius CCD camera running Digital Micrograph software.

FIG. 15*a-c* shows bright field TEM images at different magnifications of the metal nanostructures formed by using 4-(dimethylamino) benzoic acid as the organic compound. These Figures demonstrate the high yield formation of 2D metal nanostructures when using an organic compound without an azo group which fulfils the requirements of the present invention. FIG. 15*d* shows an SAED pattern of the metal nanostructures down the <111> zone axis. The strong spots (boxed) are indexed as the allowed {220} Bragg reflection (corresponding to a lattice spacing of 0.144 nm) and the weak spots (circled) are indexed as the forbidden ⅓ {422} reflections (corresponding to a lattice spacing of 0.250 nm). This indicates a <111> oriented 2D gold nanostructure with an atomically flat surface as described in Example 1. These results show that using a non-azo compound such as 4-(Dimethylamino) benzoic acid results in the formation of ultra-thin metal nanosheets similar to those of Examples 1 to 3.

EXAMPLE 5: CONTROLLABLE SYNTHESIS OF METAL NANOPLATES BY INTRODUCING $FeBr_3$

Synthesis

A freshly prepared aqueous solution (1 mL, varying concentrations, see Table 2) of iron(III) bromide ($FeBr_3$), an aqueous solution (1 mL, 5 mM) of gold chloride ($HAuCl_4$) and a freshly prepared aqueous solution (0.5 mL, 100 mM) of sodium citrate (SC) were sequentially added to an aqueous solution (3 mL, 0.28 mM) of methyl orange (MO) at a temperature of 20° C. The resultant reaction mixture was kept undisturbed at a temperature of 20° C. for 12 hours.

After 12 hours of reaction where the molar ratio of the inorganic salt relative to the source of noble metal ions was ≤0.252, the reaction products were collected by centrifugation at a relative centrifugal field (RCF) of 3000 g for a period of 10 minutes. The reaction product pellet was washed several times with water until the supernatant was colourless. The pellet was then redispersed in water for further analysis.

After 12 hours of reaction where the molar ratio of the inorganic salt relative to the source of noble metal ions was >0.252, the reaction products formed a precipitation at the bottom of the vial. After the removal of the supernatant, the products were twice redispersed in water and washed by centrifugation at a RCF of 1000 g for a period of 8 minutes. The products were then redispersed in water for further analysis.

Characterisation

The reaction products were analysed by TEM. TEM samples were prepared as described in Example 1. TEM images were taken using a Tecnai F20 TEM/STEM operated at an accelerating voltage of 200 kV, equipped with a field emission gun using an extraction voltage of 4.5 kV, an Oxford Instruments 80 $mm^2$ SD detector running Aztec software and a Gatan Orius CCD camera running Digital Micrograph software.

Representative TEM images of nanoplates produced with different molar ratios of $FeBr_3$ are shown in FIG. 16. The specific concentration of $FeBr_3$ used in each sample is summarised in Table 2.

Table 2 summarises the average edge length of nanoplates (measured by TEM) produced for different molar ratios of inorganic salt. FIG. 17 defines how the edge length of each nanoplate was measured. FIG. 18 shows histograms of nanoplate lengths for different molar ratios.

TABLE 2

Average edge length of nanoplates formed with different molar ratios of $FeBr_3$

| Concentration of $FeBr_3$ solution | $FeBr_3$:$HAuCl_4$ molar ratio | Average Edge Length (by TEM) | Corresponding TEM image | Corresponding histogram |
|---|---|---|---|---|
| 0.315 mM | 0.063 | 105 nm | FIG. 16a | FIG. 18a |
| 0.630 mM | 0.126 | 148 nm | FIG. 16b | FIG. 18b |
| 0.945 mM | 0.189 | 193 nm | FIG. 16c | FIG. 18c |

TABLE 2-continued

| Average edge length of nanoplates formed with different molar ratios of $FeBr_3$ | | | | |
|---|---|---|---|---|
| Concentration of $FeBr_3$ solution | $FeBr_3$:$HAuCl_4$ molar ratio | Average Edge Length (by TEM) | Corresponding TEM image | Corresponding histogram |
| 1.260 mM | 0.252 | 272 nm | FIG. 16d | FIG. 18d |
| 2.830 mM | 0.566 | ≈1 μm | FIG. 16e | |
| 3.850 mM | 0.770 | ≈2 μm | FIG. 16f | |

For certain molar ratios of inorganic salt, the thickness of the nanoplates was also measured by TEM imaging and/or AFM. AFM sample preparation and measurement was carried out as described in Example 1.

FIG. 19 shows a TEM image of a stack of nanoplates viewed side on formed with a $FeBr_3$ molar ratio of 0.126. A direct thickness measurement from FIG. 19 gives a nanoplate thickness (excluding the observable organic capping layer) of 6.2±0.3 nm. An AFM image of two nanoplates formed with a $FeBr_3$ molar ratio of 0.126 is shown in FIG. 20. The height profile along the red line of FIG. 20 is shown as an inset. AFM analysis reveals that the top and bottom faces are atomically flat with a thickness of 7.5± 0.4 nm. AFM measurements include the organic capping layer excluded by TEM analysis.

The crystal structure of the nanoplates formed with a $FeBr_3$ molar ratio of 0.126 was probed by HRTEM, SAED and XRD analysis. HRTEM, SAED and XRD sample preparation and measurement was carried out as described in Example 1.

FIG. 21*a* shows a TEM image of the top face of a metal nanoplate. The spacings between each set of white parallel lines is measured to be around 0.25 nm which corresponds to the ⅓ {422} lattice spacing of fcc-gold. The inset shows the SAED pattern in the <111> zone axis. Strong spots (boxed) are indexed to the allowed {220} Bragg reflection (corresponding to a lattice spacing of 0.144 nm). Weak spots (circled) are indexed to the forbidden ⅓ {422} reflections (corresponding to a lattice spacing of 0.250 nm).

FIG. 21*b* shows a TEM image of the side face of a metal nanoplate. The spacings between the white lines is measured at around 0.24 nm which corresponds to the {111} interplanar spacing of fcc-gold. This indicates that the side surface of the nanoplate comprises {111} facets. FIGS. 21*a* and 21*b* demonstrate that the nanoplates are <111> oriented gold single crystals.

FIG. 21*c* shows an XRD pattern of the nanoplates formed with a $FeBr_3$ molar ratio of 0.126. The XRD pattern exhibits only {111} peaks. This indicates that the nanoplates are <111> oriented gold single crystals.

The micro-sized nanoplates formed with higher molar ratio of inorganic salt also exhibit single crystallinity with {111} domains and atomically flat surfaces. This is exemplified by the presence of the forbidden ⅓ {422} reflections in the SAED patterns of ≈1 μm and ≈2 μm sized nanoplates (FIG. 22*a* and FIG. 22*b* respectively).

In addition to the size, the thickness of metal nanoplates formed can also be controlled by varying inorganic salt molar ratio. FIGS. 23*a-d* are histograms of the thicknesses (measured by AFM) of metal nanoplates with an average length of 148 nm FIG. 23*a*, 193 nm FIG. 23*b*, ≈1 μm FIG. 23*c* and ≈2 μm FIG. 23*d*. The average height of nanoplates increases with inorganic salt molar ratio.

The as-prepared gold nanoplates display local surface plasmon resonance (LSPR) features. These correspond to distinct dipolar and quadrupolar plasmon resonances at 1100 nm and 750 nm respectively in the UV-vis spectrum. FIG. 24 is an example of a UV-vis spectrum for metal nanoplates with an average length of 148 nm which displays these features.

EXAMPLE 6: CONTROLLABLE SYNTHESIS OF METAL NANOPLATES BY INTRODUCING NaBr

The synthetic procedure was as described in Example 5 with NaBr aqueous solution (1 mL, 1.89 mM) used instead of iron(III) bromide aqueous solution. This corresponds to a molar ratio of sodium bromide to the source of noble metal ions of 0.378.

The reaction products were analysed by TEM. TEM samples were prepared as described in Example 1. TEM images were taken using a Tecnai F20 TEM/STEM operated at an accelerating voltage of 200 kV, equipped with a field emission gun using an extraction voltage of 4.5 kV, an Oxford Instruments 80 $mm^2$ SD detector running Aztec software and a Gatan Orius CCD camera running Digital Micrograph software.

Representative TEM images of nanoplates produced when NaBr is present are shown in FIGS. 30*a* and 30*b*. Edge length measurement of the nanoplates was performed as described in Example 5. FIG. 30*c* shows a histogram of edge lengths measured from TEM images which show an average edge length of 150±7 nm.

Thickness measurements were also performed as described in Example 5 using TEM and AFM. AFM sample preparation and measurement was carried out as described in Example 1.

FIG. 30*d* shows a TEM image of a stack of nanoplates viewed side on formed with NaBr present at a molar ratio of 0.378. A direct thickness measurement from FIG. 30*d* gives a nanoplate thickness (excluding the observable organic capping layer) of approximately 10 nm. An AFM image of two nanoplates formed with NaBr present at a molar ratio of 0.378 is shown in FIG. 30*e*. The height profile along the red line of FIG. 30*e* is shown as an inset. AFM analysis reveals that the top and bottom faces are atomically flat with a nanoplate thickness of between 9 and 10 nm, in good agreement with TEM images. AFM measurements include the organic capping layer excluded by TEM analysis.

The as-prepared gold nanoplates display local surface plasmon resonance (LSPR) features. These correspond to distinct dipolar and quadrupolar plasmon resonances at 1100 nm and 750 nm respectively in the UV-vis spectrum. FIG. 30*f* is a UV-vis spectrum for metal nanoplates produced with NaBr present at a molar ratio of 0.378 which displays these features.

These results show that using a different inorganic salt also enables the production of LSPR exhibiting noble metal nanoplates of a controllable size and thickness.

EXAMPLE 7: SYNTHESIS OF METAL NANOSTRUCTURES USING ETHYL ORANGE

The synthetic procedure was as described in Example 3 with ethyl orange aqueous solution (4 mL, 0.21 mM) used instead of fenaminosulf aqueous solution.

TEM images and SAED patterns of the reaction products were taken. TEM and SAED samples were prepared as described in Example 1. TEM images shown in FIG. 25*a-c* were taken using a Tecnai F20 TEM/STEM operated at an accelerating voltage of 200 kV, equipped with a field emission gun using an extraction voltage of 4.5 kV, an Oxford Instruments 80 $mm^2$ SD detector running Aztec software and a Gatan Orius CCD camera running Digital Micrograph software. The SAED pattern shown in FIG. 25*d* was collected using a Tecnai F20 TEM/STEM operated at an accelerating voltage of 200 kV, equipped with a field emission gun using an extraction voltage of 4.5 kV, an Oxford Instruments 80 $mm^2$ SD detector running Aztec software and a Gatan Orius CCD camera running Digital Micrograph software.

FIG. 25*a-c* shows bright field TEM images which demonstrate the high yield formation of 2D metal nanostructures when using ethyl orange. FIG. 25*d* shows an SAED pattern of the metal nanostructures down the <111> zone axis. The strong spots (boxed) are indexed as the allowed {220} Bragg reflection (corresponding to a lattice spacing of 0.144 nm) and the weak spots (circled) are indexed as the forbidden ⅓ {422} reflections (corresponding to a lattice spacing of 0.250 nm). This indicates a <111> oriented 2D gold nanostructure with an atomically flat surface as shown in Example 1. These results show that using ethyl orange at the same molar ratio as methyl orange (Example 1) results in the formation of similar ultra-thin metal nanosheets.

EXAMPLE 8: SYNTHESIS OF METAL NANOSTRUCTURES USING PARA METHYL RED

The synthetic procedure was as described in Example 3 with para methyl red aqueous solution (4 mL, 0.21 mM) used instead of fenaminosulf aqueous solution.

TEM images and SAED patterns of the reaction products were taken. TEM and SAED samples were prepared as described for Example 1. TEM images shown in FIGS. 26*a-c* were taken using a Tecnai F20 TEM/STEM operated at an accelerating voltage of 200 kV, equipped with a field emission gun using an extraction voltage of 4.5 kV, an Oxford Instruments 80 $mm^2$ SD detector running Aztec software and a Gatan Orius CCD camera running Digital Micrograph software. The SAED pattern shown in FIG. 26*d* was collected using a Tecnai F20 TEM/STEM operated at an accelerating voltage of 200 kV, equipped with a field emission gun using an extraction voltage of 4.5 kV, an Oxford Instruments 80 $mm^2$ SD detector running Aztec software and a Gatan Orius CCD camera running Digital Micrograph software.

FIG. 26*a-c* shows bright field TEM images which demonstrate the high yield formation of 2D metal nanostructures when using para methyl red aqueous solution (4 mL, 0.21 mM). FIG. 26*d* shows an SAED pattern of the metal nanostructures down the <111> zone axis. The strong spots (boxed) are indexed as the allowed {220} Bragg reflection (corresponding to a lattice spacing of 0.144 nm) and the weak spots (circled) are indexed as the forbidden ⅓ {422} reflections (corresponding to a lattice spacing of 0.250 nm). This indicates a <111> oriented 2D gold nanostructure with an atomically flat surface as shown in Example 1. These results show that using para methyl red aqueous solution at the same molar ratio as methyl orange (Example 1) results in the formation of similar ultra-thin metal nanosheets.

EXAMPLE 9: SYNTHESIS OF METAL NANOSTRUCTURES USING METHYL RED

The synthetic procedure was as described in Example 3 with methyl red aqueous solution (4 mL, 0.21 mM) used instead of fenaminosulf aqueous solution.

TEM images and SAED patterns of the reaction products were taken. TEM and SAED samples were prepared as described for Example 1. TEM images shown in FIGS. 27*a-c* were taken using a Tecnai F20 TEM/STEM operated at an accelerating voltage of 200 kV, equipped with a field emission gun using an extraction voltage of 4.5 kV, an Oxford Instruments 80 $mm^2$ SD detector running Aztec software and a Gatan Orius CCD camera running Digital Micrograph software. The SAED pattern shown in FIG. 27*d* was collected using a Tecnai F20 TEM/STEM operated at an accelerating voltage of 200 kV, equipped with a field emission gun using an extraction voltage of 4.5 kV, an Oxford Instruments 80 $mm^2$ SD detector running Aztec software and a Gatan Orius CCD camera running Digital Micrograph software.

FIG. 27*a-c* shows bright field TEM images at different magnification demonstrate the high yield formation of 2D metal nanostructures when using methyl red aqueous solution. FIG. 27*d* shows an SAED pattern of the metal nanostructures down the <111> zone axis. The strong spots (boxed) are indexed as the allowed {220} Bragg reflection (corresponding to a lattice spacing of 0.144 nm) and the weak spots (circled) are indexed as the forbidden ⅓ {422} reflections (corresponding to a lattice spacing of 0.250 nm). This indicates a <111> oriented 2D gold nanostructure with an atomically flat surface, as shown in Example 1. These results show that using methyl red aqueous solution at the same molar ratio as methyl orange (Example 1) results in the formation of similar ultra-thin metal nanosheets.

EXAMPLE 10: SYNTHESIS OF METAL NANOSTRUCTURES USING 4-METHYLAMINO BENZOIC ACID

The synthetic procedure was as described in Example 3 with 4-methylamino benzoic acid aqueous solution (4 mL, 0.21 mM) used instead of fenaminosulf aqueous solution.

TEM images and SAED patterns of the reaction products were taken. TEM and SAED samples were prepared as described for Example 1. TEM images shown in FIG. 28*a-c* were taken using a Tecnai F20 TEM/STEM operated at an accelerating voltage of 200 kV, equipped with a field emission gun using an extraction voltage of 4.5 kV, an Oxford Instruments 80 $mm^2$ SD detector running Aztec software and a Gatan Orius CCD camera running Digital Micrograph software. The SAED pattern shown in FIG. 28*d* was collected using a Tecnai F20 TEM/STEM operated at an accelerating voltage of 200 kV, equipped with a field emission gun using an extraction voltage of 4.5 kV, an Oxford Instruments 80 $mm^2$ SD detector running Aztec software and a Gatan Orius CCD camera running Digital Micrograph software.

FIG. 28*a-c* shows bright field TEM images at different magnification of the metal nanostructures formed by using 4-methylamino benzoic acid as the organic compound. These Figures demonstrate the high yield formation of 2D metal nanostructures when using a different organic compound which fulfils the requirements of the present invention. FIG. 28*d* shows an SAED pattern of the metal nanostructures down the <111> zone axis. The strong spots (boxed) are indexed as the allowed {220} Bragg reflection (corresponding to a lattice spacing of 0.144 nm) and the weak spots (circled) are indexed as the forbidden ⅓ {422} reflections (corresponding to a lattice spacing of 0.250 nm). This indicates a <111> oriented 2D gold nanostructure with an atomically flat surface as shown in Example 1. These results show that using 4-methylamino benzoic acid aqueous solution at the same molar ratio as methyl orange (Example 1) results in the formation of similar ultra-thin metal nanosheets.

EXAMPLE 11: SYNTHESIS OF METAL NANOSTRUCTURES USING 2,2'-BIPYRIDINE

Desirable features for selecting a suitable organic compound for use in the present invention include the presence of hydrogen-bonding together with aromatic interactions in two axial directions. These contribute to the 2D planar stacking required to create a confinement space. Based on these criteria, 2,2'-bipyridine was also selected as a candidate compound.

An aqueous solution (1 mL, 5 mM) of gold chloride ($HAuCl_4$) and a freshly prepared aqueous solution (0.5 mL, 100 mM) of sodium citrate (SC) were sequentially added to an aqueous solution (4 mL, 0.21 mM) of 2,2'-bipyridine at a temperature of 20° C. The resultant reaction mixture was kept undisturbed at a temperature of 20° C. for 12 hours.

After 12 hours, the reaction products had formed a precipitate at the bottom of the vial. The supernatant was removed and the products were then redispersed in ultrapure water. The products were then washed twice by centrifugation at a RCF of 1000 g for a period of 8 minutes. The pellet was then redispersed in water for further analysis.

TEM images and SAED patterns of the reaction products were taken. TEM and SAED samples were prepared as described for Example 1. TEM images shown in FIG. 29*a-c* were taken using a Tecnai F20 TEM/STEM operated at an accelerating voltage of 200 kV, equipped with a field emission gun using an extraction voltage of 4.5 kV, an Oxford Instruments 80 $mm^2$ SD detector running Aztec software and a Gatan Orius CCD camera running Digital Micrograph software. The SAED pattern shown in FIG. 29*d* was collected using a Tecnai F20 TEM/STEM operated at an accelerating voltage of 200 kV, equipped with a field emission gun using an extraction voltage of 4.5 kV, an Oxford Instruments 80 $mm^2$ SD detector running Aztec software and a Gatan Orius CCD camera running Digital Micrograph software.

FIG. 29*a-c* shows bright field TEM images at different magnification of the metal nanostructures formed by using 2,2'-bipyridine as the organic compound. These Figures demonstrate the high yield formation of 2D metal nanostructures when using a different organic compound with a different structure which fulfils the requirements of the present invention. FIG. 29*d* shows an SAED pattern of the metal nanostructures down the <111> zone axis. The strong spots (boxed) are indexed as the allowed {220} Bragg reflection (corresponding to a lattice spacing of 0.144 nm) and the weak spots (circled) are indexed as the forbidden ⅓ {422} reflections (corresponding to a lattice spacing of 0.250 nm). This indicates a <111> oriented 2D gold nanostructure with an atomically flat surface as shown in Example 1. These results show that using 2,2'-bipyridine at the same molar ratio as methyl orange (Example 1) results in the formation of similar ultra-thin metal nanosheets.

The invention claimed is:

1. A method for the production of a noble metal nanomaterial comprising:

(A) adding an aqueous solution of a source of noble metal ions and a reducing agent to an aqueous solution of an organic compound to form a reaction mixture, wherein the organic compound is an organic amphiphile of molecular formula:

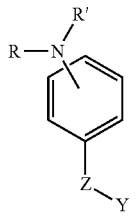

wherein:

R is hydrogen or a $C_nH_{2n+1}$ moiety, wherein $0<n\leq 6$;

R' is a $C_mH_{2m+1}$ moiety, wherein $0<m\leq 6$;

Z is a bond or a diazenyl or a diazenylbenzene linking moiety; and

Y is a carboxyl-containing, carbonyl-containing, hydroxyl-containing, anhydride-containing, amino-containing, amido-containing, sulfhydryl-containing or sulphonyl-containing moiety;

wherein the organic compound is capable of undergoing 2D planar stacking in aqueous solution; and (B) separating the noble metal nanomaterial from the reaction mixture.

2. A method as claimed in claim 1 wherein the nanomaterial is characterized by the presence of nanosheets.

3. A method as claimed in claim 2 wherein the thickness of the nanosheets measured by atomic force microscopy (AFM) is no more than 6 times the atomic radius of the noble metal.

4. A method as claimed in claim 2 wherein the thickness of the nanosheets measured by atomic force microscopy (AFM) is no more than 3 atomic layers.

5. A method as claimed in claim 2 wherein the average thickness of the nanosheets is in the range 0.40 to 0.50 nm.

6. A method as claimed in claim 1 wherein the nanomaterial is characterized by the presence of nanoplates.

7. A method as claimed in claim 1 wherein the noble metal is Au.

8. A method as claimed in claim 1 wherein the molar ratio of the organic compound to the source of noble metal ions in the reaction mixture is in the range 0.10 to 0.5.

9. A method as claimed in claim 1 further comprising:

(A') adding an aqueous solution of an inorganic salt to the reaction mixture.

10. A method as claimed in claim 9 wherein the molar ratio of the inorganic salt to the source of noble metal ions in the reaction mixture is in the range 0.1 to 0.8.

* * * * *